US012195243B2

(12) United States Patent
Purdy et al.

(10) Patent No.: US 12,195,243 B2
(45) Date of Patent: Jan. 14, 2025

(54) BOTTLE CAP DRIP TRAY DEVICE

(71) Applicant: Sarah J. Purdy, Columbus, OH (US)

(72) Inventors: Sarah J. Purdy, Columbus, OH (US); Steven A. Sauer, Columbus, OH (US)

(73) Assignee: Sarah J. Purdy, Columbus, OH (US)

( * ) Notice: Subject to any disclaimer, the term of this patent is extended or adjusted under 35 U.S.C. 154(b) by 0 days.

(21) Appl. No.: 18/238,263

(22) Filed: Aug. 25, 2023

(65) Prior Publication Data

US 2024/0391660 A1 Nov. 28, 2024

Related U.S. Application Data

(60) Provisional application No. 63/469,017, filed on May 25, 2023.

(51) Int. Cl.
*B65D 47/40* (2006.01)
*B65D 1/02* (2006.01)
(Continued)

(52) U.S. Cl.
CPC ..... *B65D 47/40* (2013.01); *B65D 1/0207* (2013.01); *B65D 1/0246* (2013.01); *B65D 41/04* (2013.01); *B65D 43/16* (2013.01); *B65D 47/06* (2013.01); *B65D 51/18* (2013.01); *B65D 51/245* (2013.01); *B65D 2203/00* (2013.01);
(Continued)

(58) Field of Classification Search
CPC .... B65D 47/40; B65D 1/0207; B65D 1/0246; B65D 41/04; B65D 43/16; B65D 47/06; B65D 51/18; B65D 51/245; B65D 2203/00; B65D 2251/0021; B65D 2251/0046; B65D 2543/00092; B65D 2543/00351
USPC ..... 215/235, 237; 220/376, 716, 718, 840; 222/556
See application file for complete search history.

(56) References Cited

U.S. PATENT DOCUMENTS 1,449,335 A 3/1923 Latham
2,793,790 A 5/1957 Kahler
(Continued)

FOREIGN PATENT DOCUMENTS

CN 202687035 U 1/2013
DE 20306410 U1 * 6/2003 ..... B65D 23/065
WO WO-2005058722 A2 * 6/2005 ..... B65D 47/088

OTHER PUBLICATIONS

"Honey Bear Replacement Cap (Blue)", TalkTools Website, Web page <https://talktools.com/products/honey-bear-replacement-cap-blue>, 5 pages, dated at least as early as Jul. 29, 2022, retrieved from Internet Archive Wayback Machine <https://web.archive.org/web/20220526054402/https://talktools.com/products/honey-bear-replacement-cap-blue> on Sep. 23, 2023.
(Continued)

*Primary Examiner* — James N Smalley
(74) *Attorney, Agent, or Firm* — The Law Office of Patrick F. O'Reilly III, LLC

(57) ABSTRACT

A bottle cap drip tray device is disclosed herein. The bottle cap drip tray device includes an upstanding inner wall portion; an upturned peripheral edge portion extending at least partially around an outer periphery of the bottle cap drip tray device; and a floor portion extending between the upstanding inner wall portion and the upturned peripheral edge portion. The bottle cap drip tray device is configured to prevent a substance being poured from a bottle from dripping down one or more sides of the bottle.

13 Claims, 18 Drawing Sheets

(51) Int. Cl.

| | |
|---|---|
| ***B65D 41/04*** | (2006.01) |
| ***B65D 43/16*** | (2006.01) |
| ***B65D 47/06*** | (2006.01) |
| ***B65D 51/18*** | (2006.01) |
| ***B65D 51/24*** | (2006.01) |

(52) U.S. Cl.
CPC ..... *B65D 2251/0021* (2013.01); *B65D 2251/0046* (2013.01); *B65D 2543/00092* (2013.01); *B65D 2543/00351* (2013.01)

(56) References Cited

U.S. PATENT DOCUMENTS

| | | | | | |
|---|---|---|---|---|---|
| 2,948,452 | A | * | 8/1960 | Grogan | B65D 85/78 229/932 |
| 3,021,977 | A | * | 2/1962 | Hester | B65D 47/06 215/DIG. 7 |
| 3,279,638 | A | * | 10/1966 | Merry | A47G 19/22 215/396 |
| 3,306,512 | A | * | 2/1967 | Pagnini | B65D 85/78 426/135 |
| 4,591,078 | A | * | 5/1986 | Weissman | B65D 47/0814 222/571 |
| 4,638,916 | A | * | 1/1987 | Beck | B65D 47/0814 215/235 |
| 4,718,594 | A | * | 1/1988 | Harazi | A23G 9/506 D7/630 |
| 4,723,693 | A | * | 2/1988 | DeCoster | B65D 47/0876 222/545 |
| 4,742,928 | A | * | 5/1988 | Braun | B65D 47/0885 222/534 |
| 4,801,054 | A | * | 1/1989 | Nycz | B65D 47/0838 222/545 |
| 4,984,697 | A | | 1/1991 | Kelly | |
| 5,084,932 | A | | 2/1992 | Zanchi | |
| 5,131,571 | A | * | 7/1992 | Nolley | B65D 47/06 222/530 |
| 5,702,013 | A | | 12/1997 | Freed | |
| 5,809,935 | A | | 9/1998 | Kolterman et al. | |
| 5,967,384 | A | * | 10/1999 | Mengeu | B65D 47/089 222/563 |
| D419,867 | S | * | 2/2000 | Hager | D9/608 |
| 6,102,257 | A | * | 8/2000 | Goyet | B65D 47/0861 222/498 |
| 6,305,584 | B1 | * | 10/2001 | Dobobrov | B65D 47/12 D7/510 |
| D451,020 | S | | 11/2001 | Koenig | |
| D458,380 | S | | 6/2002 | Dutil | |
| D460,356 | S | | 7/2002 | Koenig | |
| 6,976,610 | B2 | | 12/2005 | Rigel | |
| 7,128,243 | B2 | | 10/2006 | Fallaha | |
| 7,857,168 | B2 | | 12/2010 | Horstman et al. | |
| 8,087,547 | B1 | | 1/2012 | Lindsey | |
| D733,898 | S | | 7/2015 | Cloney | |
| 9,624,001 | B1 | | 4/2017 | Hill | |
| 10,106,300 | B2 | | 10/2018 | Brannon et al. | |
| 2003/0189068 | A1 | * | 10/2003 | Nash | B65D 23/065 222/571 |
| 2004/0206721 | A1 | | 10/2004 | Swanberg et al. | |
| 2008/0314924 | A1 | | 12/2008 | Moeller et al. | |
| 2013/0202747 | A1 | | 8/2013 | Kopel et al. | |
| 2014/0319007 | A1 | | 10/2014 | Long et al. | |
| 2015/0329255 | A1 | | 11/2015 | Rzepecki | |

OTHER PUBLICATIONS

"Honey Dispenser No Drip Glass", Walmart Website, Web page <https://www.walmart.ca/en/ip/Honey-Dispenser-No-Drip-Glass-Maple-Syrup-Dispenser-Glass-Beautiful-Honey-Comb-Shaped-Honey-Pot-Honey-Jar-with-Stand-Great-Bee-D-cor/PRD57ZLWCFIT47N>, 6 pages, dated at least as early as Jul. 29, 2022, retrieved from www.amazon.com website on Sep. 23, 2023.

"Clover Honey 12 oz Bear Bottle", Hunter's Honey Farm Website, Web page <https://huntershoneyfarm. com/product/clover-honey-12-oz-bear/>, 2 pages, dated at least as early as Jul. 29, 2022, retrieved from www.huntershoneyfarm.com website on Sep. 23, 2023.

"Sierra Silver Tequila 70cl", Spirit King Website, Web page <https://www.spiritking.co.uk/products/sierra-silver-tequila-70cl>, 5 pages, dated at least as early as Aug. 7, 2023, retrieved from spiritking.co.uk website on Sep. 23, 2023.

PCT Form PCT/ISA/206, Invitation to Pay Additional Fees for PCT/US2024/031166, mailed on Aug. 9, 2024.

International Search Report Form PCT/ISA/210, Application No. PCT/US2024/031166, date of mailing: Oct. 25, 2024, 4 pages.

Written Opinion of the International Searching Authority, PCT Form 237, Application No. PCT/US2024/031166, date of mailing: Oct. 25, 2024, 9 pages.

* cited by examiner

SECTION A-A

SECTION B-B

SECTION F-F 350
350

BOTTLE CAP DRIP TRAY DEVICE

CROSS-REFERENCE TO RELATED APPLICATIONS

This patent application claims priority to, and incorporates by reference in its entirety, U.S. Provisional Patent Application No. 63/469,017, entitled "Bottle Cap Drip Tray Device", filed on May 25, 2023.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a bottle cap drip tray device. More particularly, the invention relates to a bottle cap drip tray device that is configured to prevent a substance being dispensed from a bottle from dripping down one or more sides of the bottle.

2. Background

When various liquid and semi-liquid substances are poured from a bottle, it is very difficult, if not impossible, to prevent any drips from going down the one or more sides of the bottle. This is particularly a problem when pouring sticky substances from a bottle, such as honey. For example, honey bottles are often sticky after only one use. Also, when the bottle becomes sticky, the sticky bottle commonly results in sticky hands after use. In addition, when a bottom of the bottle becomes sticky, this leads to the further problem of the bottle sticking to any surface on which it is placed (e.g., countertops, pantry shelves, etc.), thereby making that surface sticky as well.

Therefore, what is needed is a bottle cap drip tray device that prevents a substance being poured out of a bottle from dripping down one or more sides of the bottle. In addition, a bottle cap drip tray device is needed that prevents bottles from becoming dirty and/or sticky as result of the substance being poured therefrom dripping down the one or more sides of the bottle.

BRIEF SUMMARY OF EMBODIMENTS OF THE INVENTION

Accordingly, the present invention is directed to a bottle cap drip tray device that substantially obviates one or more problems resulting from the limitations and deficiencies of the related art.

In accordance with one or more embodiments of the present invention, there is provided a bottle cap drip tray device that includes an upstanding inner wall portion; an upturned peripheral edge portion extending at least partially around an outer periphery of the bottle cap drip tray device; and a floor portion extending between the upstanding inner wall portion and the upturned peripheral edge portion. In these one or more embodiments, the bottle cap drip tray device is configured to prevent a substance being poured from a bottle from dripping down onc or more sides of the bottle.

In a further embodiment of the present invention, the bottle cap drip tray device further comprises a bottle cap configured to engage with an opening of the bottle, the bottle cap including a cap base portion, the cap base portion formed by the upstanding inner wall portion and a top wall connected to the upstanding inner wall portion, and the cap base portion further including a dispensing aperture disposed through the top wall for pouring the substance from the bottle; and a lid portion pivotably coupled to the cap base portion, the lid portion being pivotable between a closed position where the dispensing aperture is covered and an open position where the dispensing aperture is accessible for the pouring of the substance.

In yet a further embodiment, the bottle cap further comprises a hinge member pivotably coupling the lid portion to the cap base portion of the bottle cap.

In still a further embodiment, the hinge member defines a substantially horizontal pivot axis about which the lid portion is rotatable relative to the cap base portion of the bottle cap.

In yet a further embodiment, the hinge member is coupled to the cap base portion by one or more resilient prong members that engage with a slot disposed in the cap base portion.

In still a further embodiment, the hinge member comprises a pair of downwardly extending tabs with respective hinge pins extending from the tabs, and the hinge member is coupled to the cap base portion by the hinge pins engaging with respective pin holes in the cap base portion.

In yet a further embodiment, the cap base portion comprises an upstanding collar circumscribing the dispensing aperture, and the lid portion comprises a circular recess at a bottom of the lid portion for accommodating the upstanding collar of the cap base portion when the lid portion is in the closed position.

In still a further embodiment, an interior surface of the upstanding inner wall portion of the cap base portion comprises a plurality of internal threads that are configured to threadingly engage with a plurality of corresponding external threads disposed on a neck of the bottle.

In yet a further embodiment, the bottle cap drip tray device has an inverted frustoconical shape where the upturned peripheral edge portion of the bottle cap drip tray device is sloped upwardly in an outward direction.

In still a further embodiment, the upturned peripheral edge portion has a top rim and the lid portion of the bottle cap has a top surface, the top rim of the upturned peripheral edge portion being disposed beneath the top surface of the lid portion of the bottle cap.

In yet a further embodiment, the bottle has an animal or human figurine shape, and the bottle cap drip tray device is in a shape of a hat disposed on a head of the animal or human figurine.

In still a further embodiment, the bottle cap drip tray device has an annular shape with a central aperture for accommodating an existing bottle cap disposed on the bottle, the upstanding inner wall portion of the bottle cap drip tray device defining the central aperture, and the upstanding inner wall portion of the bottle cap drip tray device configured to removably engage a peripheral wall of the existing bottle cap in a friction-fit type engagement.

In yet a further embodiment, the bottle has an animal or human figurine shape, and the bottle cap drip tray device forms a brim of a hat disposed on a head of the animal or human figurine.

In still a further embodiment, the bottle cap drip tray device further comprises a hat crown portion configured to fit over a top edge portion of the existing bottle cap or a top edge portion of the upstanding inner wall portion of the bottle cap drip tray device so that the hat crown portion and the bottle cap drip tray device together form the hat on the head of the animal or human figurine.

In yet a further embodiment, the bottle cap drip tray device has a two-part construction with an inner ring portion formed from a first polymeric material and an outer drip tray portion formed from a second polymeric material, the first polymeric material being more flexible than the second polymeric material to facilitate engaging the peripheral wall of the existing bottle cap.

In still a further embodiment, the bottle cap drip tray device has an inverted frustoconical shape where the upturned peripheral edge portion of the bottle cap drip tray device is sloped upwardly in an outward direction.

In yet a further embodiment, the floor portion and/or the upturned peripheral edge portion of the bottle cap drip tray device has a textured inner surface comprising a plurality of ribs that define recesses between the ribs for trapping the substance being poured from the bottle.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 14:
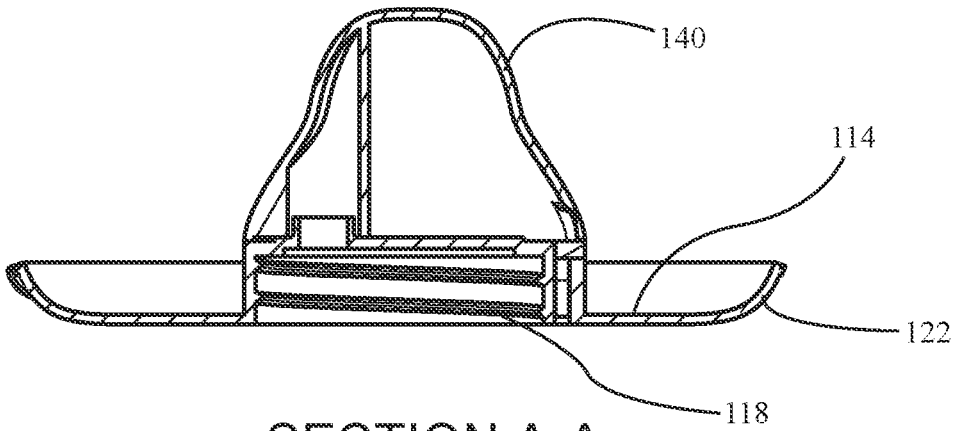
FIG. 14 is a sectional view cut through the bottle cap drip tray device of FIG. 2, wherein the section is generally cut along the cutting-plane line A-A in FIG. 13.

A first illustrative embodiment of a bottle cap drip tray device is seen generally at 100 in FIGS. 1-15. With initial reference to FIGS. 1 and 2, it can be seen that the bottle cap drip tray device 100 generally comprises an upstanding inner wall portion 112; an upturned peripheral edge portion 110 extending around an outer periphery of the bottle cap drip tray device 100; and a floor portion 114 extending between the upstanding inner wall portion 112 and the upturned peripheral edge portion 110. As best shown in FIGS. 2 and 14 of the first illustrative embodiment, the upturned peripheral edge portion 110 may comprise a curved wall portion 122 extending upwardly from the generally flat floor portion 114. The bottle cap drip tray device 100 is configured to prevent a substance being poured from a bottle 170 from dripping down one or more sides of the bottle 170.

In the first illustrative embodiment, the bottle 170 has an animal figurine shape (i.e., bottle 170 is a bear-shaped honey bottle), and the bottle cap drip tray device 100 is in a shape of a hat disposed on a head of the animal figurine (i.e., a sombrero-shaped hat disposed on the bear-shaped honey bottle).

Referring again to FIGS. 1 and 2, the bottle cap drip tray device 100 of the first illustrative embodiment further comprises a bottle cap 112, 120, 140 configured to engage with an opening of the bottle 170. The bottle cap 112, 120, 140 includes a cap base portion 112, 120, the cap base portion 112, 120 formed by the upstanding inner wall portion 112 and a top wall 120 connected to the upstanding inner wall portion 112, and the cap base portion 112, 120 further including a dispensing spout 113 with a dispensing aperture disposed through the top wall 120 for pouring the substance from the bottle 170. The bottle cap 112, 120, 140 further includes a lid portion 140 pivotably coupled to the cap base portion 112, 120, the lid portion 140 being pivotable between a closed position (i.e., FIG. 1 position) where the dispensing aperture is covered and an open position (i.e., FIG. 2 position) where the dispensing aperture is accessible for the pouring of the substance.

Figure 11:
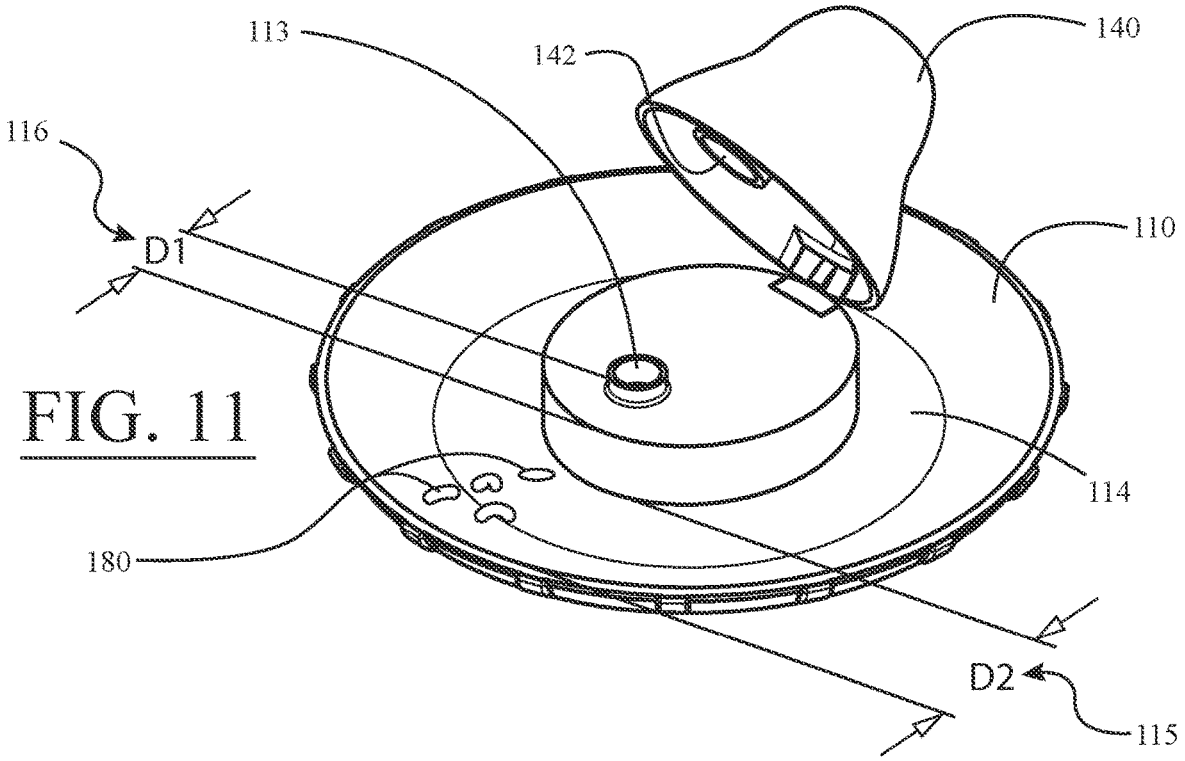
FIG. 11 is yet another side-top perspective view of the bottle cap drip tray device of FIG. 2, wherein a dispensed substance is shown on the top surface of the bottle cap drip tray device.

Advantageously, as shown in FIG. 11, the bottle cap drip tray device 100 adds an additional distance D2, measured from the upstanding cylindrical wall portion 112 to the outer rim of the upturned peripheral edge portion 110, to the distance D1, measured from the edge of the dispensing spout 113 to the edge of the upstanding cylindrical wall portion 112, for catching drips 180 of the substance being dispensed from the bottle (e.g., drops of honey). In the first illustrative embodiment of FIG. 11, the additional distance D2 (denoted by reference character 115) added by the bottle cap drip tray device 100 is approximately twice the distance D1 (denoted by reference character 116) from the edge of the dispensing spout 113 to the edge of the cap base portion 112, 120.

Figure 1:
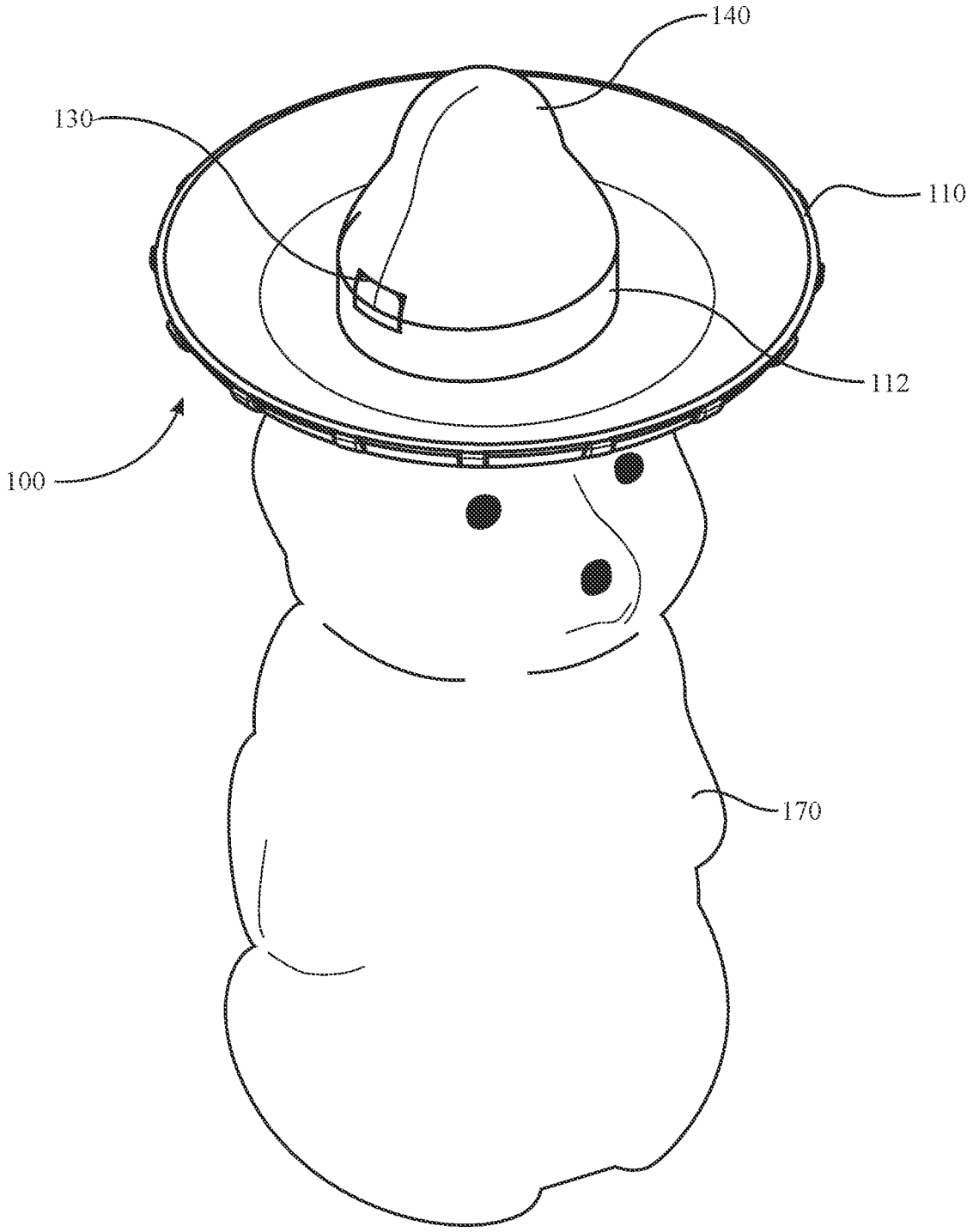
FIG. 1 is a perspective view of a bottle cap drip tray device, according to a first illustrative embodiment of the invention, wherein the bottle cap drip tray device is disposed on a bear-shaped honey bottle.
Figure 2:
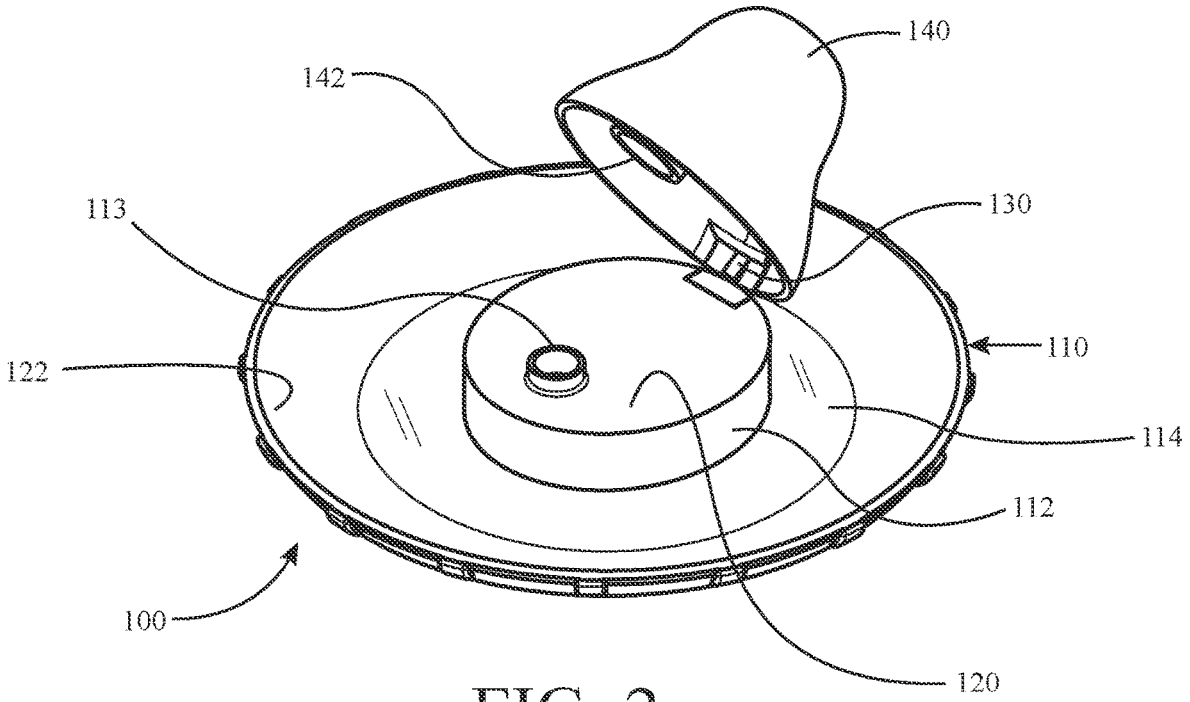
FIG. 2 is a side-top perspective view of the bottle cap drip tray device of FIG. 1, wherein the bottle cap drip tray device has been removed from the bear-shaped honey bottle, and the cap member of the bottle cap drip tray device is in a partially open position.
Figure 3:
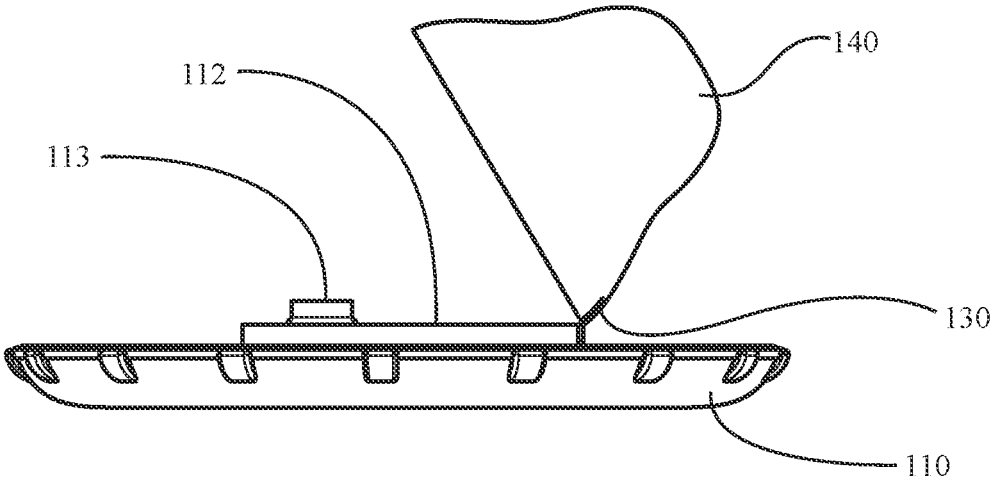
FIG. 3 is a first side elevational view of the bottle cap drip tray device of FIG. 2.
Figure 4:
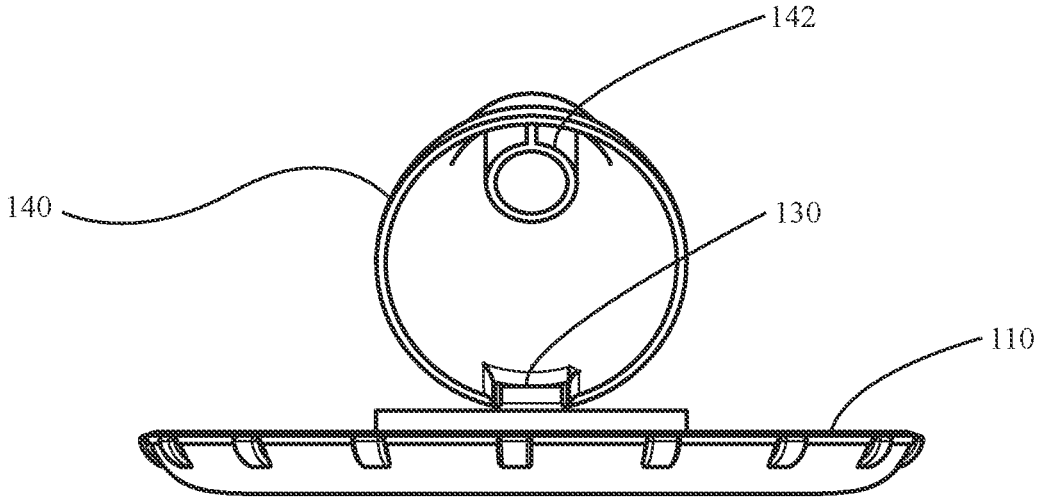
FIG. 4 is a front elevational view of the bottle cap drip tray device of FIG. 2.
Figure 5:
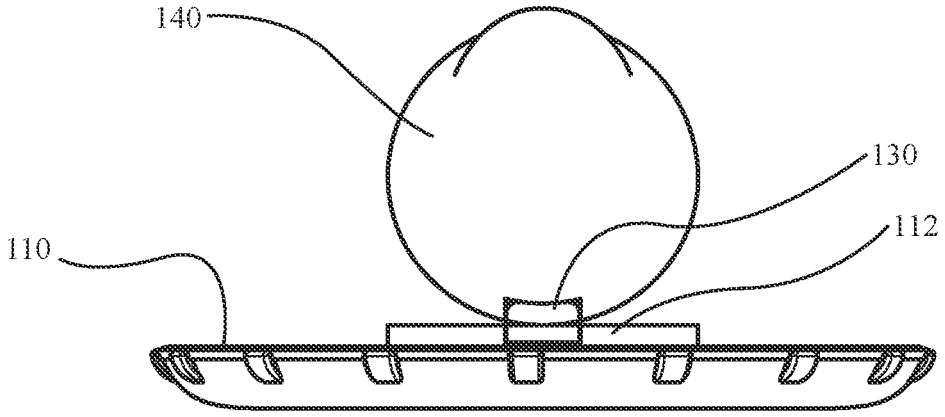
FIG. 5 is a rear elevational view of the bottle cap drip tray device of FIG. 2.
Figure 6:
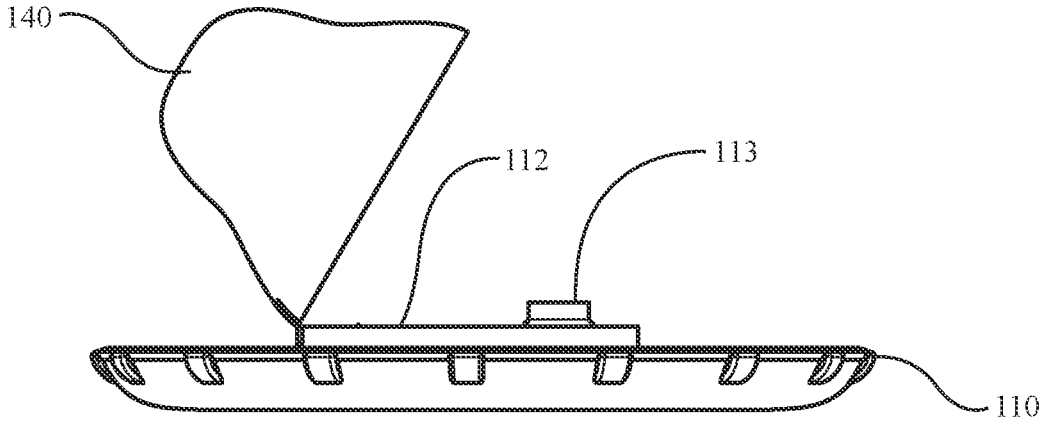
FIG. 6 is a second side elevational view of the bottle cap drip tray device of FIG. 2.
Figure 7:
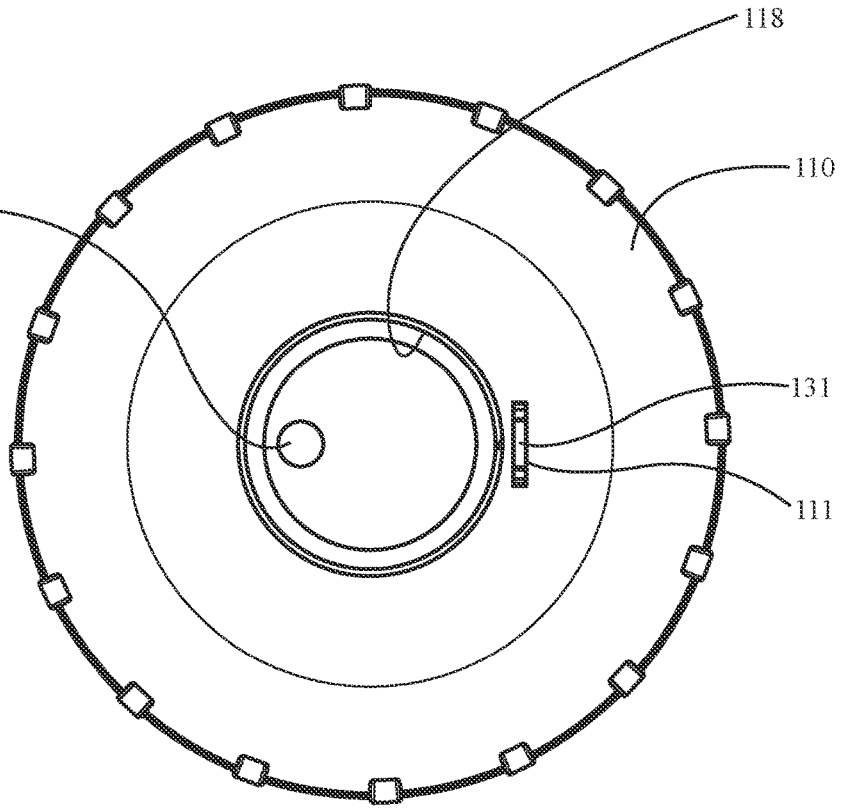
FIG. 7 is a bottom plan view of the bottle cap drip tray device of FIG. 2.
Figure 8:
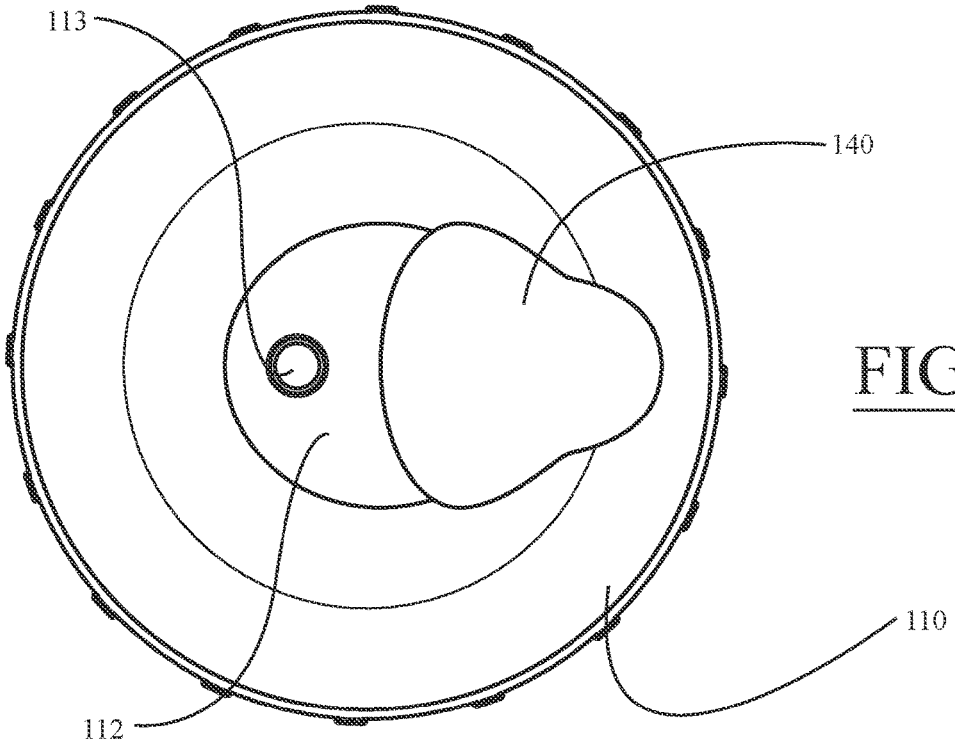
FIG. 8 is a top plan view of the bottle cap drip tray device of FIG. 2.

Also, as shown in FIGS. 1 and 2, the bottle cap 112, 120, 140 of the first illustrative embodiment further comprises a hinge member 130 pivotably coupling the lid portion 140 to the cap base portion 112, 120 of the bottle cap 112, 120, 140. In the first illustrative embodiment, the hinge member 130 is in a form of a thin flexible living hinge or integral hinge that is made from the same material as the lid portion 140 and/or the cap base portion 112, 120. Also, as shown in FIGS. 2, 3, 6, and 10, the hinge member 130 of the first illustrative embodiment defines a pair of substantially horizontal pivot axes 136, 138 about which the lid portion 140 is rotatable relative to the cap base portion 112, 120 of the bottle cap 112, 120, 140. In the first illustrative embodiment, each horizontal pivot axis 136, 138 of the hinge member 130 allows at least 90 degrees of rotation.

Figure 9:
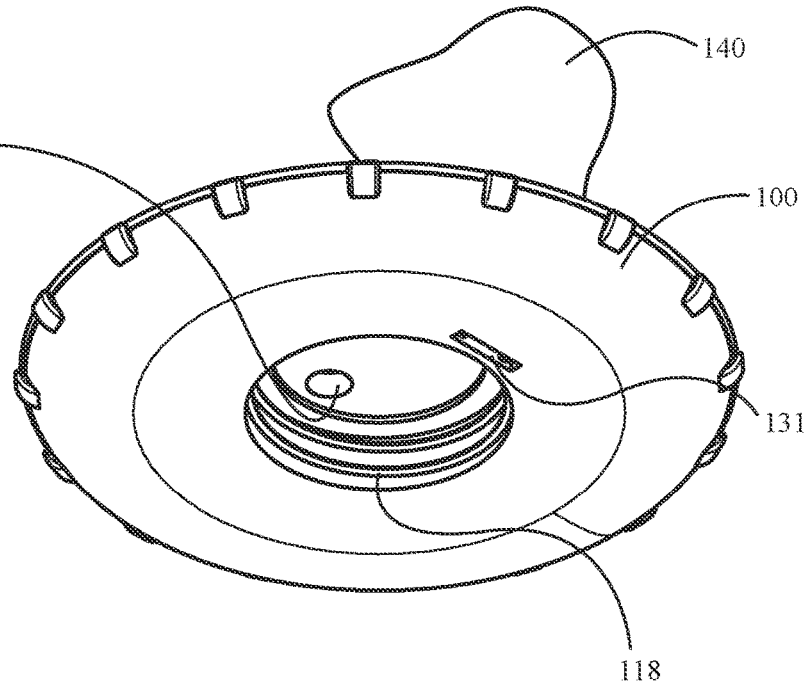
FIG. 9 is a bottom perspective view of the bottle cap drip tray device of FIG. 2.
Figure 10:
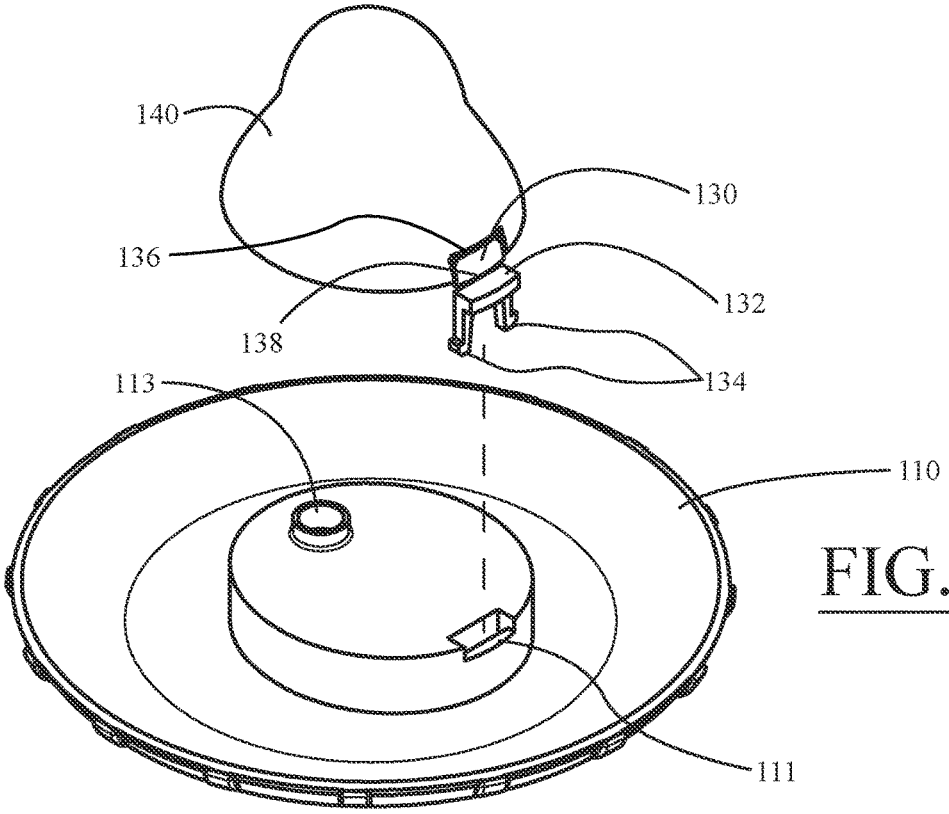
FIG. 10 is another side-top perspective view of the bottle cap drip tray device of FIG. 2, wherein the cap member and hinge are shown removed from the remainder of the bottle cap drip tray device.
Figure 15A:
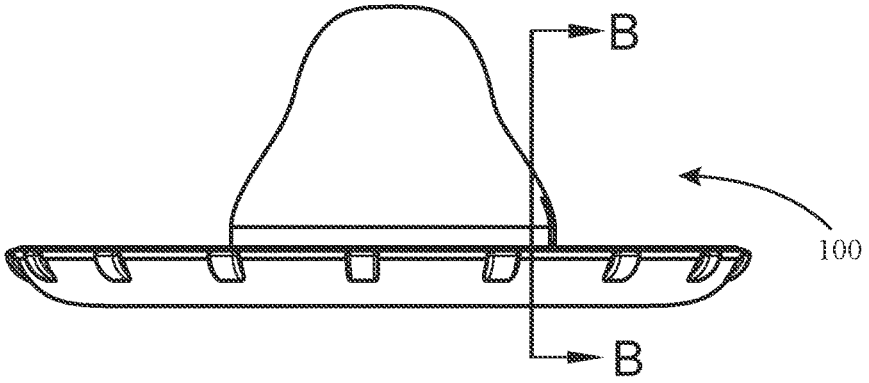
FIG. 15A is another front elevational view of the bottle cap drip tray device of FIG. 2, wherein the cap member of the bottle cap drip tray device is in a closed position.
Figure 15B:
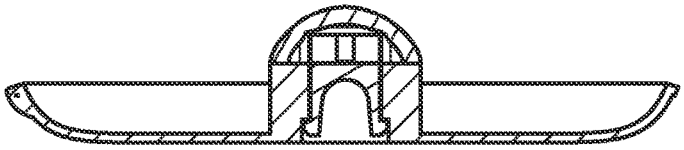
FIG. 15B is a sectional view cut through the bottle cap drip tray device of FIG. 2, wherein the section is generally cut along the cutting-plane line B-B in FIG. 15A.

Now, as best shown in FIGS. 9 and 10, it can be seen that the hinge member 130 of the first illustrative embodiment is coupled to the cap base portion 112, 120 by a pair of resilient prong members 134 that engage with a slot 131 disposed in the cap base portion 112, 120 (i.e., the prong members 134 snap into the slot 131—see FIG. 15B). As shown in FIG. 10, the resilient prong members 134 of the living hinge are connected to a snap-in piece 132 that snaps into a notch 111 above the slot 131 of the cap base portion 112, 120. The snap-in piece 132 connects to the remainder of the hinge member 130 along the pivot line 138 (see FIG. 10). In the first illustrative embodiment, the hinge member 130 and attached lid portion 140 can be removed from the cap base portion 112, 120 by squeezing the distal ends of the resilient prong members 134 inwardly (e.g., using a pair of tweezers) so that the prong members 134 can be slid out of the slot 131.

With reference again to FIGS. 2 and 10, it can be seen that the dispensing spout 113 of the cap base portion 112, 120 comprises an upstanding collar circumscribing the dispensing aperture. The lid portion 140 comprises a spout cover 142 with a circular recess at a bottom of the lid portion 140 for accommodating the upstanding collar of the cap base portion 112, 120 when the lid portion 140 is in the closed position (see FIGS. 2 and 14). In the sectional view of FIG. 14, it can be seen that the spout cover 142 is disposed over the dispensing spout 113 in the closed position of the lid portion 140 to contain the substance contained in the bottle 170 within the cavity defined by the spout cover 142 (so that the substance does not leak into the remainder of the interior lid cavity).

Next, referring to the bottom perspective view of FIG. 9, it can be seen that the circular interior surface of the upstanding inner wall portion 112 of the cap base portion 112, 120 comprises a plurality of internal threads 118 that are configured to threadingly engage with a plurality of corresponding external threads disposed on a neck of the bottle 170.

Figure 12:
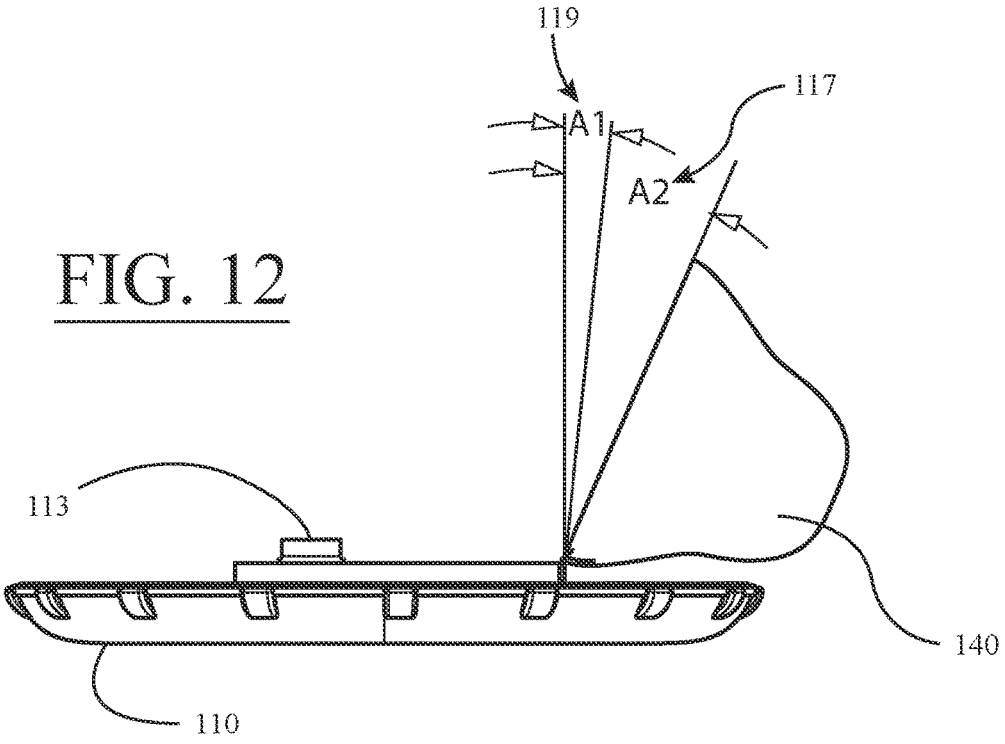
FIG. 12 is another first side elevational view of the bottle cap drip tray device of FIG. 2, wherein a range of cap opening angles are depicted therein.
Figure 13:
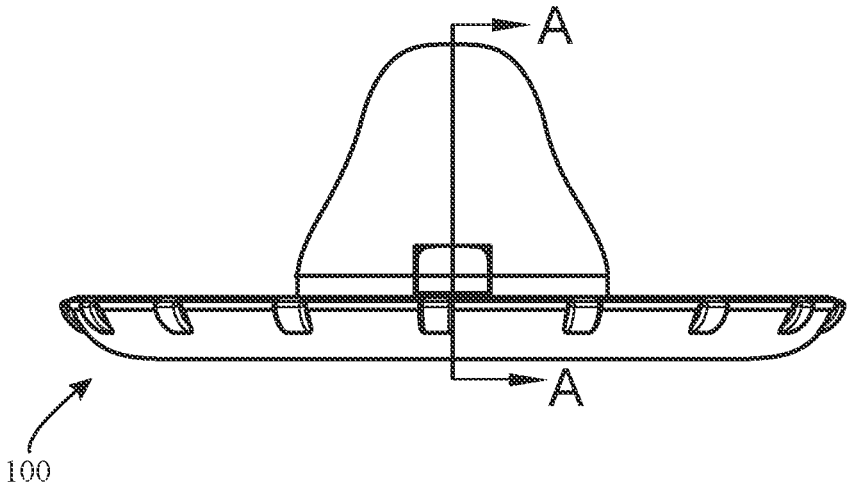
FIG. 13 is another rear elevational view of the bottle cap drip tray device of FIG. 2, wherein the cap member of the bottle cap drip tray device is in a closed position.

As shown in FIG. 12, in the first illustrative embodiment, if the lid portion 140 is rotated to the angle A2 position past a vertical line reference, the lid portion 140 will stay in an open position without flexing back to a closed position. Conversely, if the lid portion 140 is only rotated to the angle A1 position past a vertical line reference in FIG. 12, the lid portion 140 will generally flex back to a partially closed position or a closed position. In the first illustrative embodiment, the angle A2 (denoted by reference character 117) may be the maximum opening angle for the lid portion 140, while the angle A1 (denoted by reference character 119) may be an intermediate opening angle for the lid portion 140.

Figure 16:
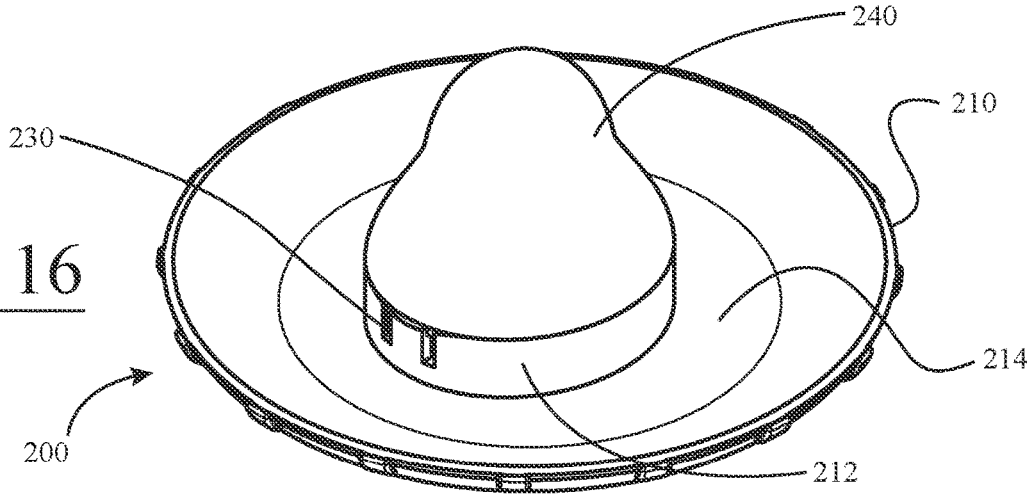
FIG. 16 is a side-top perspective view of a bottle cap drip tray device, according to a second illustrative embodiment of the invention.
Figure 17:
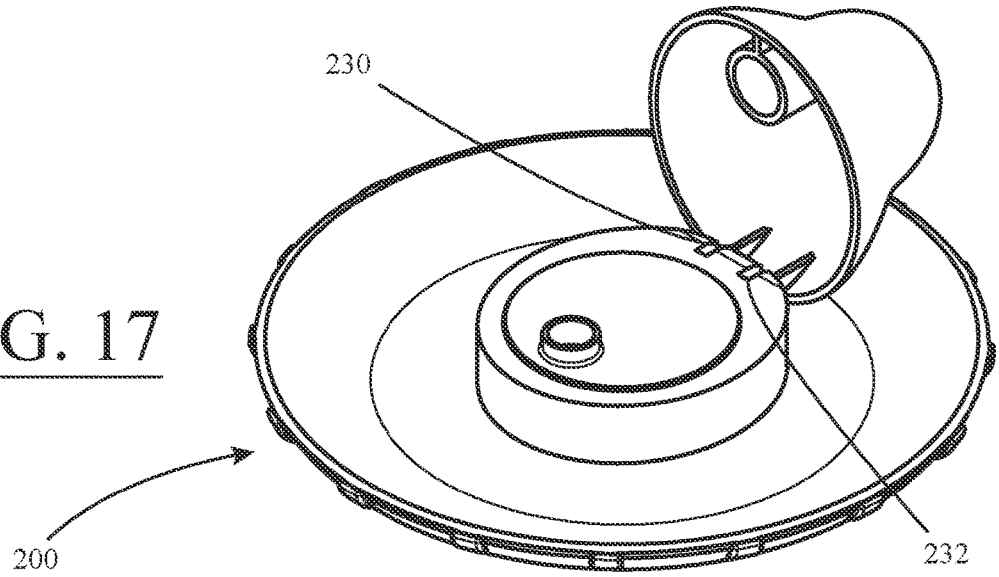
FIG. 17 is another side-top perspective view of the bottle cap drip tray device of FIG. 16, wherein the cap member of the bottle cap drip tray device is in an open position.
Figure 18:
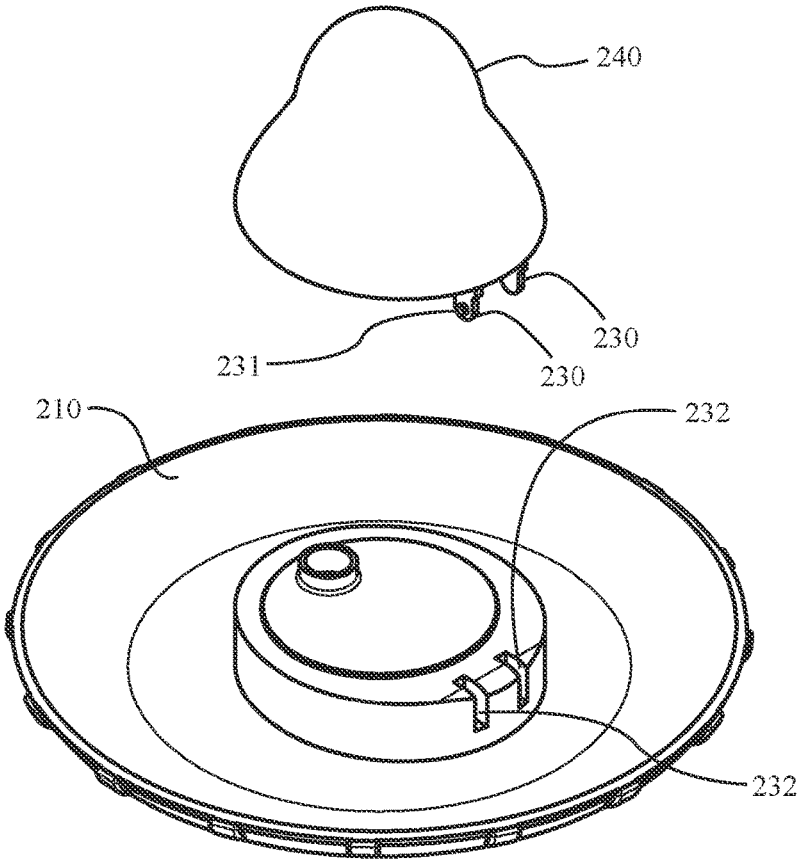
FIG. 18 is yet another side-top perspective view of the bottle cap drip tray device of FIG. 16, wherein the cap member and hinge are shown removed from the remainder of the bottle cap drip tray device.

A second illustrative embodiment of a bottle cap drip tray device is seen generally at 200 in FIGS. 16-18. Referring to these figures, it can be seen that, in most respects, the second illustrative embodiment is the same as the first illustrative embodiment. Moreover, nearly all of the elements are common to both such embodiments. For the sake of brevity, the elements that the second embodiment of the bottle cap drip tray device has in common with the first embodiment will not be discussed because these components have already been described above.

As shown in FIGS. 16-18, similar to the bottle cap drip tray device 100 described above, the bottle cap drip tray device 200 generally comprises an upstanding inner wall portion 212; an upturned peripheral edge portion 210 extending around an outer periphery of the bottle cap drip tray device 200; and a floor portion 214 extending between the upstanding inner wall portion 212 and the upturned peripheral edge portion 210. The bottle cap drip tray device 200 is configured to prevent a substance being poured from a bottle from dripping down one or more sides of the bottle.

However, referring to FIGS. 17 and 18, it can be seen that the bottle cap drip tray device 200 has a hinge member that is different from the hinge member 130 of the first illustrative embodiment. In particular, as shown in FIG. 18, it can be seen that the hinge member comprises a pair of downwardly extending tabs 230 with respective hinge pins 231 extending from the tabs 230. The hinge member is coupled to the cap base portion by the hinge pins 231 engaging with respective pin holes in the cap base portion. The cap base portion is provided with a pair of spaced-apart slots 232 for receiving the pair of downwardly extending tabs 230 attached to the underside of the lid portion 240 (refer to FIG. 18). In the second illustrative embodiment, the hinge member is in a form of a snap-in type hinge (i.e., the hinge pins 231 snap into the pin holes of the cap base portion when the downwardly extending tabs 230 are inserted into the slots 232).

A third illustrative embodiment of a bottle cap drip tray device is seen generally at 300 in FIGS. 19-25. Referring to these figures, it can be seen that, in most respects, the third illustrative embodiment is the same as the first and second illustrative embodiments. Moreover, nearly all of the elements are common to these embodiments. For the sake of brevity, the elements that the third embodiment of the bottle cap drip tray device has in common with the first and second embodiments will not be discussed because these components have already been described above.

Figure 22:
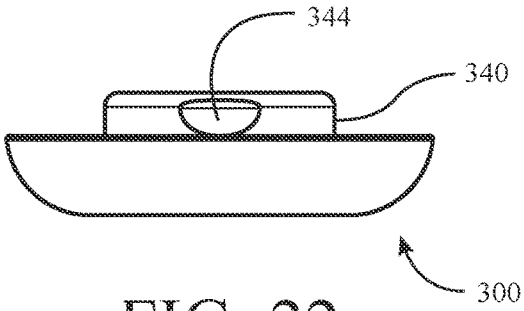
FIG. 22 is a front elevational view of the bottle cap drip tray device of FIG. 19.
Figure 23:
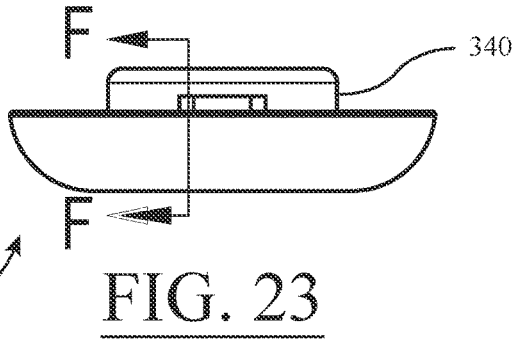
FIG. 23 is a rear elevational view of the bottle cap drip tray device of FIG. 19.
Figure 24:
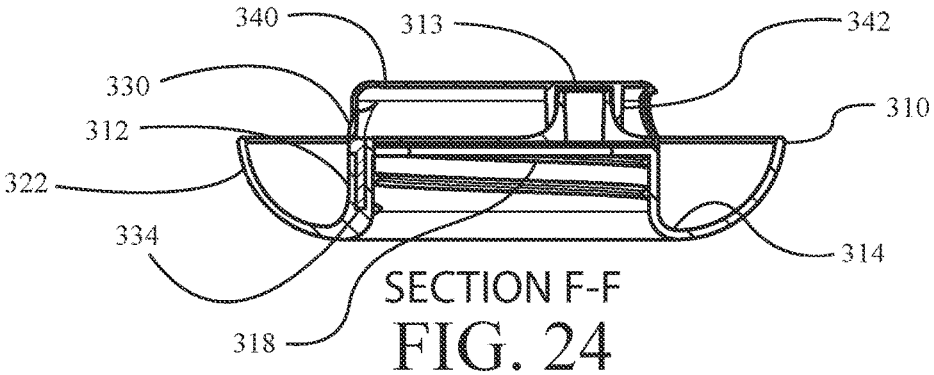
FIG. 24 is a sectional view cut through the bottle cap drip tray device of FIG. 19, wherein the section is generally cut along the cutting-plane line F-F in FIG. 23.

As shown in FIGS. 19-25, similar to the bottle cap drip tray devices 100, 200 described above, the bottle cap drip tray device 300 generally comprises an upstanding inner wall portion 312; an upturned peripheral edge portion 310 extending around an outer periphery of the bottle cap drip tray device 300; and a floor portion 314 extending between the upstanding inner wall portion 312 and the upturned peripheral edge portion 310. As best shown in FIG. 24 of the third illustrative embodiment, the upturned peripheral edge portion 310 may comprise a curved wall portion 322 extending upwardly from the floor portion 314. Like the bottle cap drip tray devices 100, 200 described above, the bottle cap drip tray device 300 is configured to prevent a substance being poured from a bottle from dripping down one or more sides of the bottle.

Referring again to FIGS. 19, 24, and 25, the bottle cap drip tray device 300 of the third illustrative embodiment further comprises a bottle cap 312, 320, 340 configured to engage with an opening of a bottle. The bottle cap 312, 320, 340 includes a cap base portion 312, 320, the cap base portion 312, 320 formed by the upstanding inner wall portion 312 and a top wall 320 connected to the upstanding inner wall portion 312, and the cap base portion 312, 320 further including a dispensing spout 313 with a dispensing aperture disposed through the top wall 320 for pouring the substance from a bottle. The bottle cap 312, 320, 340 further includes a lid portion 340 pivotably coupled to the cap base portion 312, 320, the lid portion 340 being pivotable between a closed position (i.e., FIG. 19 position) where the dispensing aperture is covered and an open position where the dispensing aperture is accessible for the pouring of the substance. As shown in FIG. 22, the lid portion 340 of the bottle cap 312, 320, 340 comprises a finger recess 344 for facilitating the grasping of the lid portion 340 by a user so that the lid portion 340 is able to be more easily opened.

As shown in FIGS. 22-24, in the third illustrative embodiment, the top rim of the upturned peripheral edge portion 310 of the bottle cap drip tray device 300 is disposed beneath the top surface of the lid portion 340 of bottle cap 312, 320, 340 so that a user of the bottle cap drip tray device 300 does not mistakenly use the upturned peripheral edge portion 310 of the bottle cap drip tray device 300 as a stand for the bottle when the bottle is inverted. In the third illustrative embodiment, it can be seen that the upturned peripheral edge portion 310 does not extend outwardly from the upstanding inner wall portion 312 as far as the upturned peripheral edge portion 310 of the first illustrative embodiment. Also, as best illustrated in FIGS. 22-24, the upturned peripheral edge portion 310 of the bottle cap drip tray device 300 is generally bowl-shaped in the third illustrative embodiment.

Figure 19:
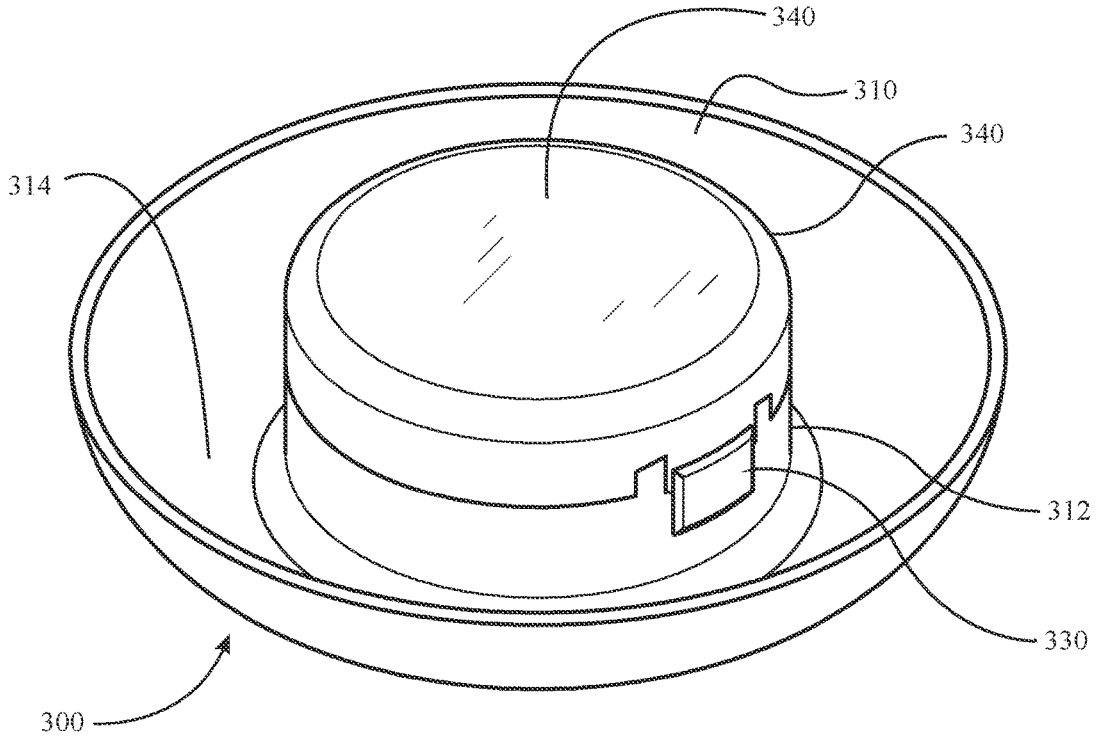
FIG. 19 is a perspective view of a bottle cap drip tray device, according to a third illustrative embodiment of the invention.
Figure 20:
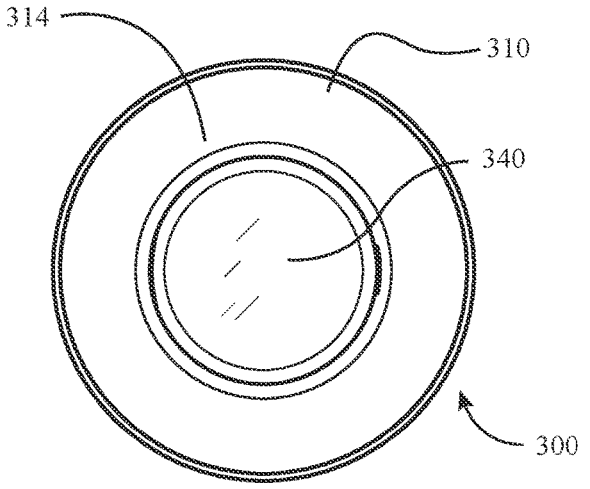
FIG. 20 is a top plan view of the bottle cap drip tray device of FIG. 19.
Figure 21:
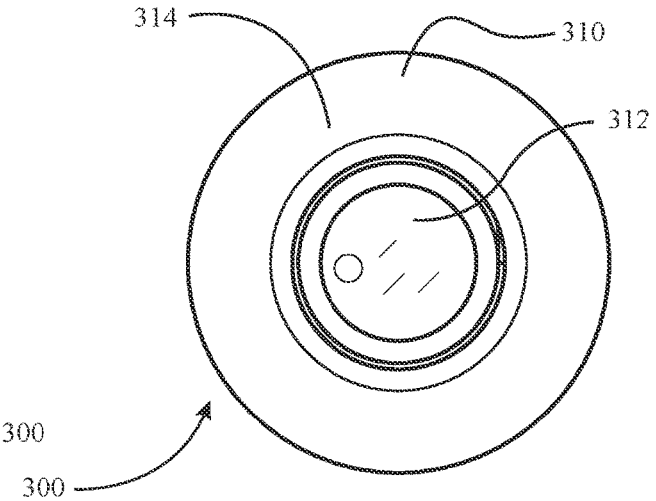
FIG. 21 is a bottom plan view of the bottle cap drip tray device of FIG. 19.
Figure 25:
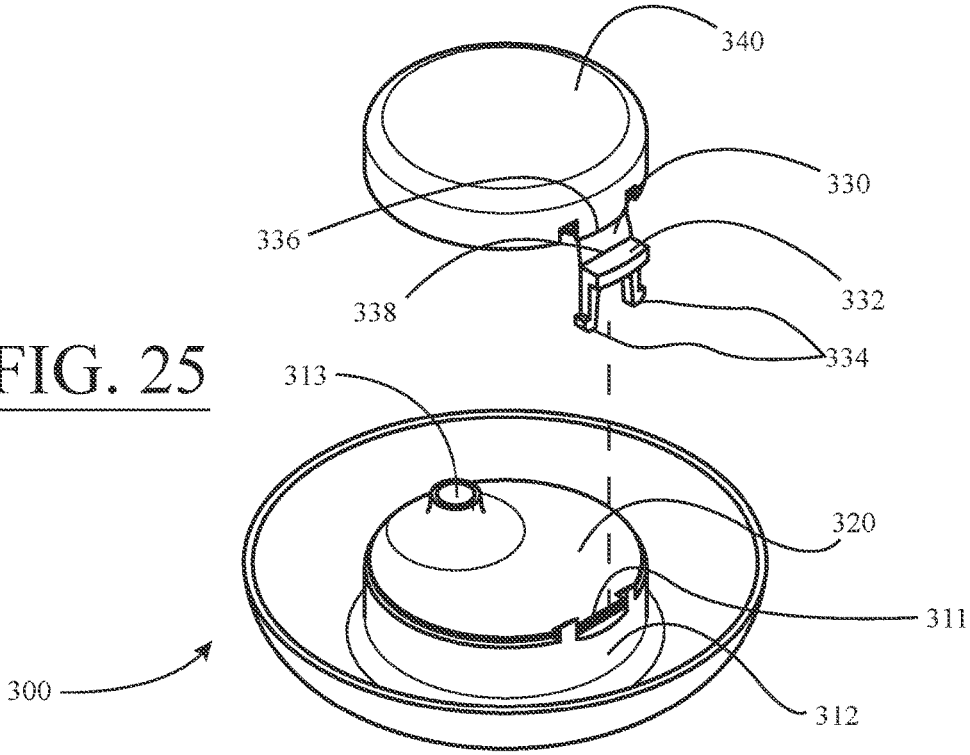
FIG. 25 is another side-top perspective view of the bottle cap drip tray device of FIG. 19, wherein the cap member and hinge are shown removed from the remainder of the bottle cap drip tray device.

Also, as shown in FIGS. 19, 24, and 25, the bottle cap 312, 320, 340 of the third illustrative embodiment further comprises a hinge member 330 pivotably coupling the lid portion 340 to the cap base portion 312, 320 of the bottle cap 312, 320, 340. In the third illustrative embodiment, as in the first embodiment, the hinge member 330 is in a form of a thin flexible living hinge or integral hinge that is made from the same material as the lid portion 340 and/or the cap base portion 312, 320. Also, as shown in FIG. 25, the hinge member 330 of the third illustrative embodiment defines a pair of substantially horizontal pivot axes 336, 338 about which the lid portion 340 is rotatable relative to the cap base portion 312, 320 of the bottle cap 312, 320, 340. In the third illustrative embodiment, each horizontal pivot axis 336, 338 of the hinge member 330 allows at least 90 degrees of rotation. Referring to FIGS. 22 and 23, it can be seen that, in the third illustrative embodiment, the hinge member 330 is disposed on an opposite side of the lid portion 340 as the finger recess 344.

Now, as best shown in FIGS. 24 and 25, it can be seen that the hinge member 330 of the third illustrative embodiment is coupled to the cap base portion 312, 320 by a pair of resilient prong members 334 that engage with a slot 311 disposed in the cap base portion 312, 320 (i.e., the prong members 334 snap into the slot 311—see FIG. 25). As shown in FIG. 25, the resilient prong members 334 of the living hinge are connected to a snap-in piece 332 that snaps into a notch above the slot 311 of the cap base portion 312, 320. The snap-in piece 332 connects to the remainder of the hinge member 330 along the lower pivot line 338 (see FIG. 25). In the third illustrative embodiment, the hinge member 330 and attached lid portion 340 can be removed from the cap base portion 312, 320 by squeezing the distal ends of the resilient prong members 334 inwardly (e.g., using a pair of tweezers) so that the prong members 334 can be slid out of the slot 311. The sectional view of FIG. 24 is cut through one of the prong members 334 of the hinge member 330.

With reference again to FIGS. 24 and 25, it can be seen that the dispensing spout 313 of the cap base portion 312, 320 comprises an upstanding collar circumscribing the dispensing aperture. The lid portion 340 comprises a spout cover 342 with a circular recess at a bottom of the lid portion 340 for accommodating the upstanding collar of the cap base portion 312, 320 when the lid portion 340 is in the closed position (see FIGS. 24 and 25). In the sectional view of FIG. 24, it can be seen that the spout cover 342 is disposed over the dispensing spout 313 in the closed position of the lid portion 340 to contain the substance contained in a bottle within the cavity defined by the spout cover 342 (so that the substance does not leak into the remainder of the interior lid cavity).

Next, referring to the sectional view of FIG. 24, it can be seen that the circular interior surface of the upstanding inner wall portion 312 of the cap base portion 312, 320 comprises a plurality of internal threads 318 that are configured to threadingly engage with a plurality of corresponding external threads disposed on a neck of a bottle.

Figure 26:
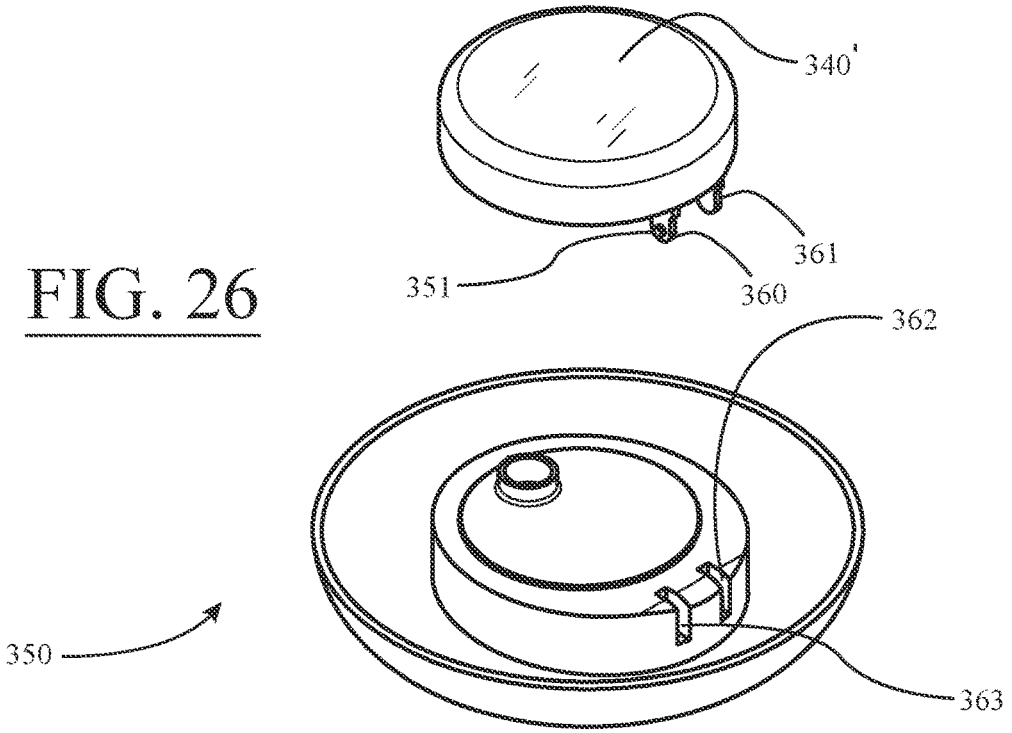
FIG. 26 is a perspective view of the bottle cap drip tray device of the third illustrative embodiment with an alternative hinge provided on the cap member thereof, wherein the cap member and hinge are shown removed from the remainder of the bottle cap drip tray device.
Figure 27:
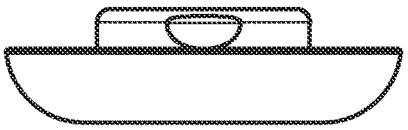
FIG. 27 is a front elevational view of the bottle cap drip tray device of FIG. 26.
Figure 28:
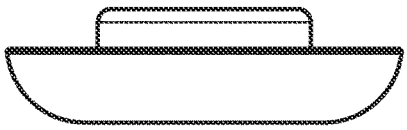
FIG. 28 is a rear elevational view of the bottle cap drip tray device of FIG. 26.

A modified version of the bottle cap drip tray device of the third illustrative embodiment is depicted in FIGS. 26-28. In particular, referring to the perspective view of FIG. 26, it can be seen that the bottle cap drip tray device 350 has a hinge member that is different from the hinge member 330 described above. As shown in FIG. 26, it can be seen that the hinge member comprises a pair of downwardly extending tabs 360 with respective hinge pins 351, 361 extending from the tabs 360. The hinge member is coupled to the cap base portion by the hinge pins 351, 361 engaging with respective pin holes in the cap base portion. The cap base portion is provided with a pair of spaced-apart slots 362, 363 for receiving the pair of downwardly extending tabs 360 attached to the underside of the lid portion 340' (refer to FIG. 26). In the modified illustrative embodiment of FIGS. 26-28, the hinge member is in a form of a snap-in type hinge (i.e., the hinge pins 351, 361 snap into the pin holes of the cap base portion when the downwardly extending tabs 360 are inserted into the slots 362, 363).

Figure 29:
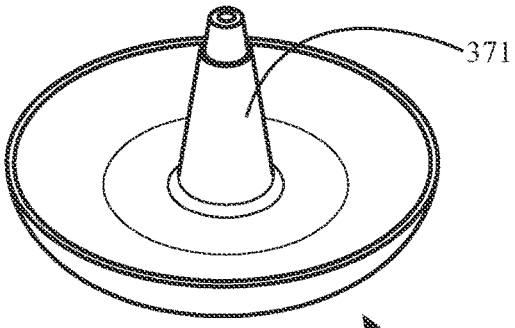
FIG. 29 is a perspective view of the bottle cap drip tray device of the third illustrative embodiment with a first alternative cap provided thereon.

Another modified version of the bottle cap drip tray device of the third illustrative embodiment is depicted in FIG. 29. In particular, referring to the perspective view of FIG. 29, it can be seen that the bottle cap drip tray device 370 has a different bottle cap 371. The bottle cap 371 depicted in FIG. 29 has an outer frustoconical sleeve that twists open so as to enable a substance to be poured from a bottle. Then, to close the bottle cap 371, a user twists the outer frustoconical sleeve in a closed rotational direction that is opposite to the open rotational direction.

Figure 30:
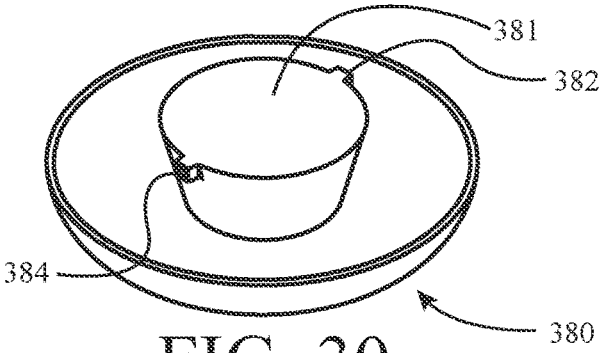
FIG. 30 is a perspective view of the bottle cap drip tray device of the third illustrative embodiment with a second alternative cap provided thereon.

Yet another modified version of the bottle cap drip tray device of the third illustrative embodiment is depicted in FIG. 30. In particular, referring to the perspective view of FIG. 30, it can be seen that the bottle cap drip tray device 380 has a different bottle cap 381. The bottle cap 381 depicted in FIG. 30 has an inverted frustoconical cap member with an air intake 382 disposed on one side of the cap member and a pour opening 384 disposed on an opposite side of the cap member. When a substance is poured from a bottle, the substance (e.g., a liquid) is dispensed through the pour opening 384, while air enters air intake 382 on the opposite side of the cap member to facilitate the pouring of the substance through pour opening 384.

Figure 31:
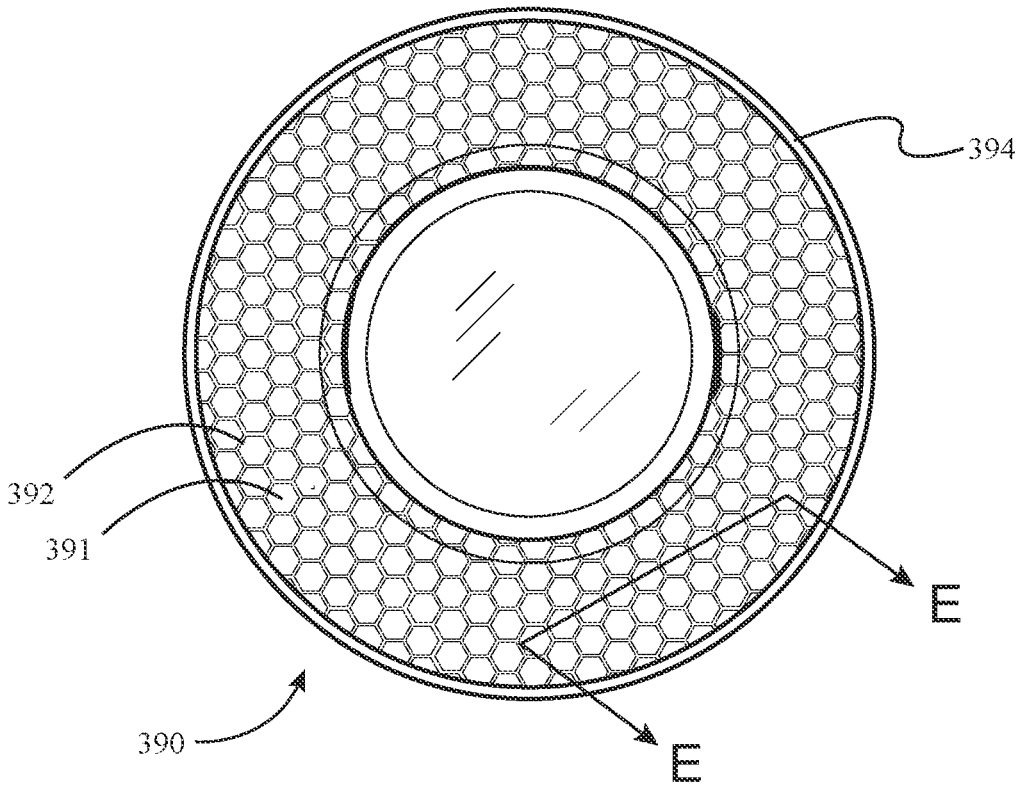
FIG. 31 is a top plan view of the bottle cap drip tray device of the third illustrative embodiment with an alternative textured inner surface of the upturned peripheral edge portion provided on the bottle cap drip tray device.
Figure 32:
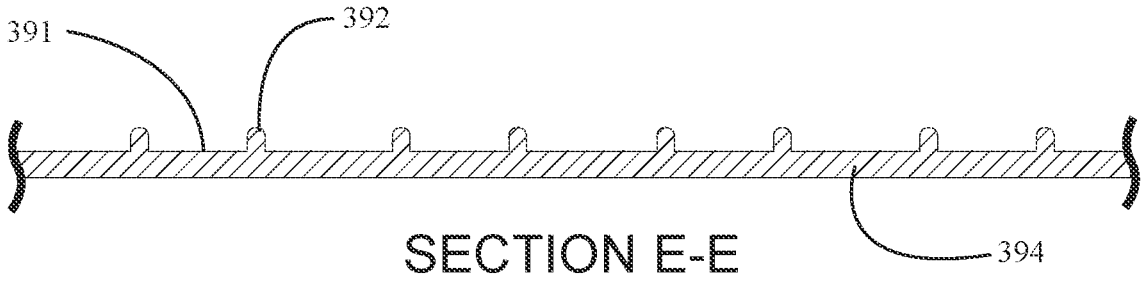
FIG. 32 is a sectional view cut through the floor portion of the bottle cap drip tray device of FIG. 31, wherein the section is generally cut along the cutting-plane line E-E in FIG. 31.

Still another modified version of the bottle cap drip tray device of the third illustrative embodiment is depicted in FIGS. 31 and 32. In particular, referring to the top plan view of FIG. 31 and the sectional view of FIG. 32, it can be seen that the bottle cap drip tray device 390 has an upturned peripheral edge portion 394 with a textured inner surface that includes an intersecting pattern of ribs 392 that define small recesses or valleys 391 between the ribs 392. Advantageously, the textured inner surface of the upturned peripheral edge portion 394 keeps a viscous material or liquid being dispensed from a bottle in place by trapping the viscous material or liquid in the recesses or valleys 391 between the ribs 392. While the inner surface of the upturned peripheral edge portion 394 of the bottle cap drip tray device 390 is provided with a textured honeycomb pattern in the embodiment of FIGS. 31 and 32, it is to be understood that, in other embodiments, the inner surface of the upturned peripheral edge portion 394 may be provided with different textured patterns having recesses or valleys defined between ribs for containing viscous material or liquid being dispensed from a bottle.

Figure 33:
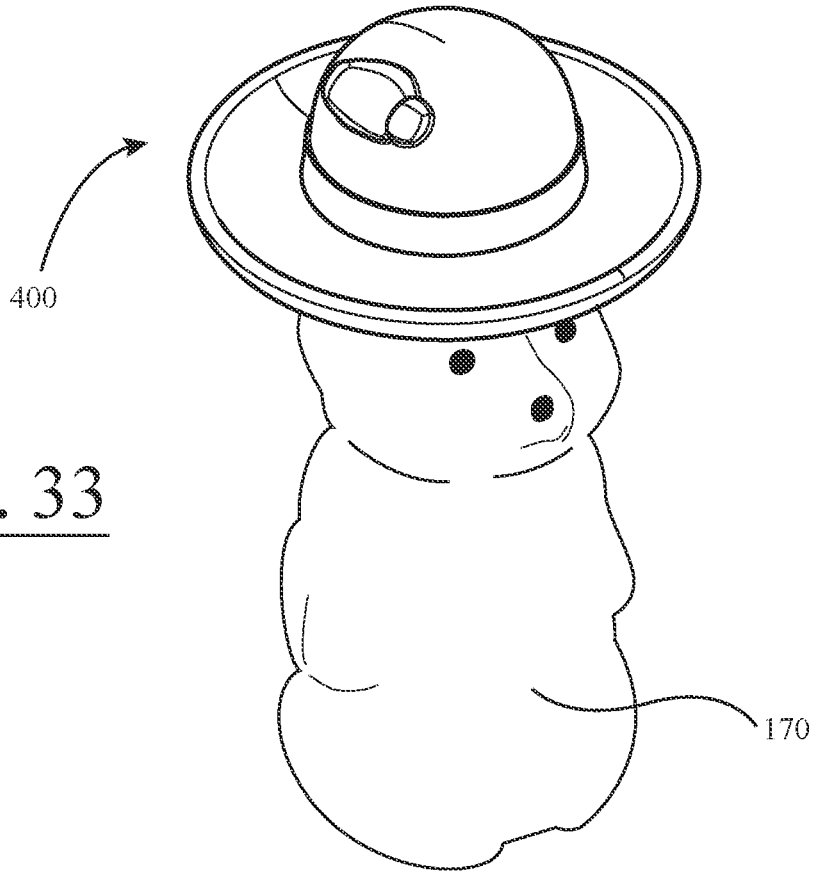
FIG. 33 is a perspective view of a bottle cap drip tray device, according to a fourth illustrative embodiment of the invention, wherein the bottle cap drip tray device is disposed on a bear-shaped honey bottle.
Figure 34:
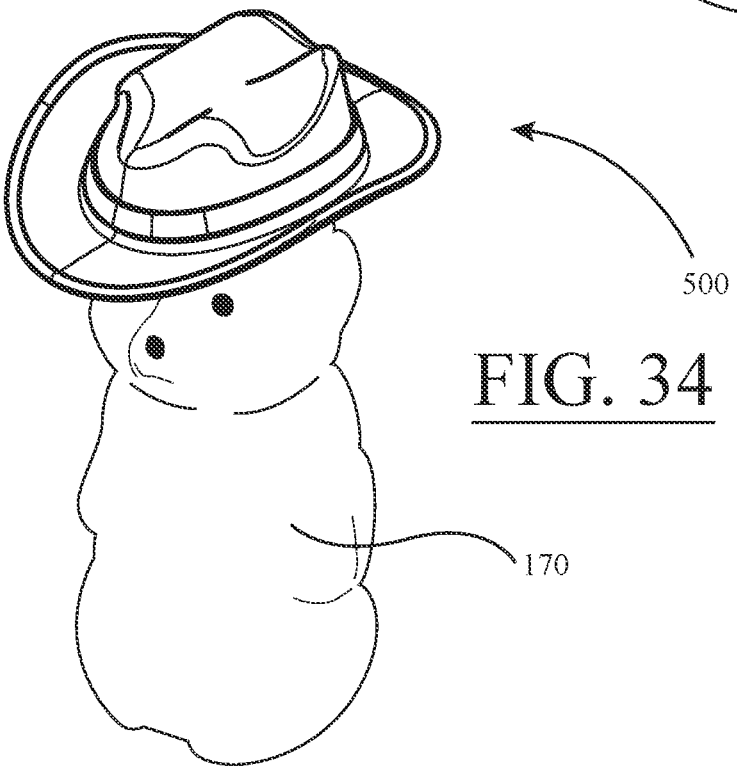
FIG. 34 is a perspective view of a bottle cap drip tray device, according to a fifth illustrative embodiment of the invention, wherein the bottle cap drip tray device is disposed on a bear-shaped honey bottle.

A fourth illustrative embodiment of a bottle cap drip tray device is seen generally at 400 in FIG. 33, while a fifth illustrative embodiment of a bottle cap drip tray device is seen generally at 500 in FIG. 34. Referring to these figures, it can be seen that, in most respects, the fourth and fifth illustrative embodiments are the same as the illustrative embodiments described above. Moreover, nearly all of the elements are common to all of the embodiments. However, unlike the first and second illustrative embodiments described above, the bottle cap drip tray devices 400, 500 comprise different-shaped hats on the bottles 170. In particular, as shown in FIG. 33, the bottle cap drip tray device 400 is in a form of a beekeeper-style hat. As depicted in FIG. 34, the bottle cap drip tray device 500 is in a form of a western-inspired hat (e.g., a cowboy hat).

Figure 35:
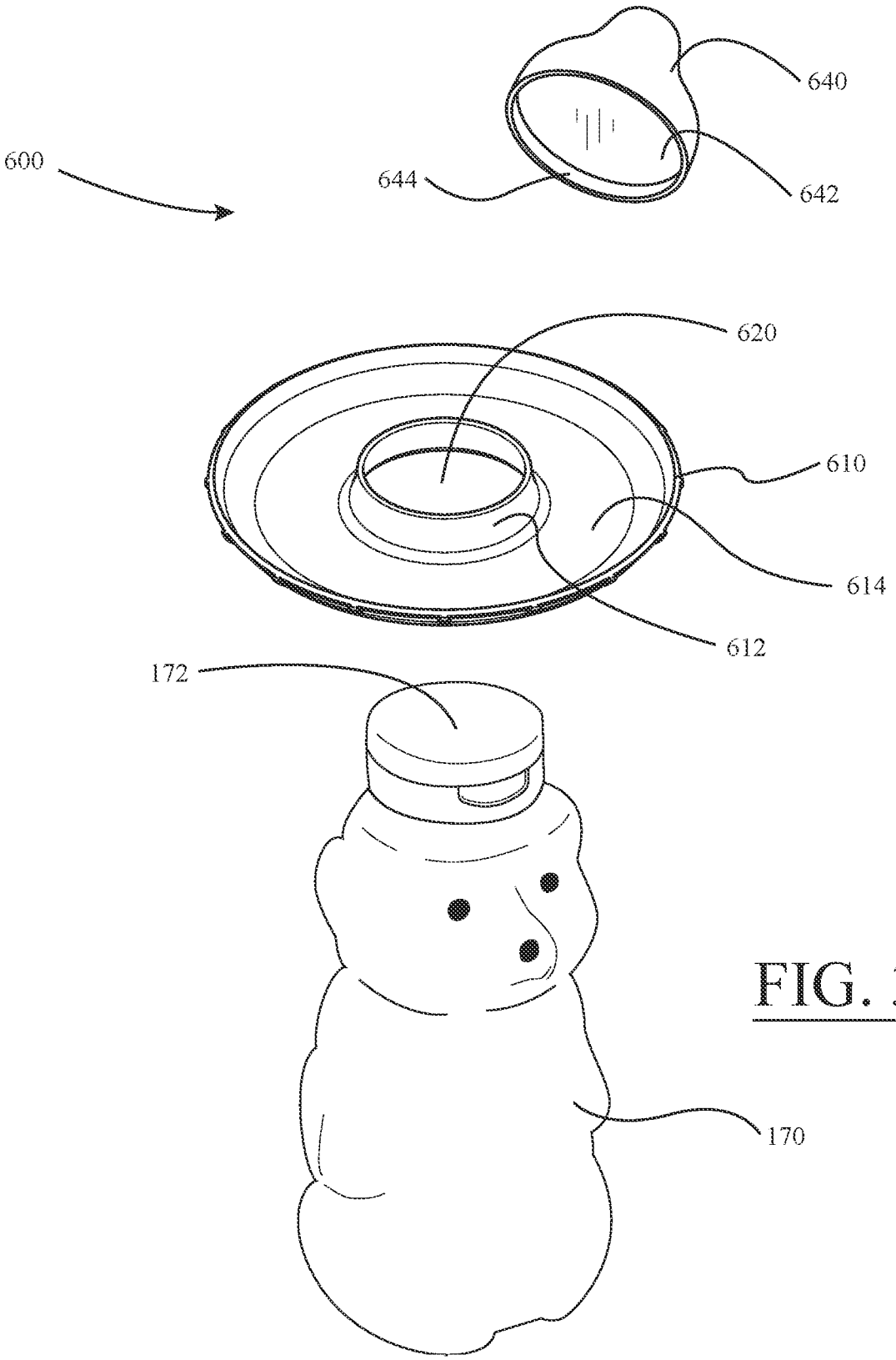
FIG. 35 is an exploded perspective view of a bottle cap drip tray device, according to a sixth illustrative embodiment of the invention, wherein the bottle cap drip tray device is shown removed from a bear-shaped honey bottle.

A sixth illustrative embodiment of a bottle cap drip tray device is seen generally at 600 in FIG. 35. Referring to this figure, it can be seen that, in some respects, the sixth illustrative embodiment is similar to the preceding illustrative embodiments. Moreover, some elements are common to all of the embodiments. For the sake of brevity, the elements that the sixth embodiment of the bottle cap drip tray device has in common with the preceding embodiments will not be discussed because these components have already been described above.

As shown in FIG. 35, similar to the bottle cap drip tray devices 100, 200, 300, 400, 500 described above, the bottle cap drip tray device 600 generally comprises an upstanding inner wall portion 612; an upturned peripheral edge portion 610 extending around an outer periphery of the bottle cap drip tray device 600; and a floor portion 614 extending between the upstanding inner wall portion 612 and the upturned peripheral edge portion 610. The bottle cap drip tray device 600 is configured to prevent a substance being poured from a bottle from dripping down one or more sides of the bottle.

However, referring to FIG. 35, it can be seen that, unlike the preceding illustrative embodiments, the bottle cap drip tray device 600 has an annular shape with a central aperture 620 for accommodating an existing bottle cap 172 disposed on a bottle 170. In the sixth illustrative embodiment, the upstanding inner wall portion 612 of the bottle cap drip tray device 600 defines the central aperture 620, and the upstanding inner wall portion 612 of the bottle cap drip tray device 600 is configured to removably engage a peripheral wall of the existing bottle cap 172 in a friction-fit type engagement.

Referring again to FIG. 35, it can be seen that the bottle 170 has an animal figurine shape (i.e., bottle 170 is a bear-shaped honey bottle), and the bottle cap drip tray device 600 forms a brim of a hat disposed on a head of the animal figurine (i.e., a brim of the hat disposed on the bear-shaped honey bottle). Also, as shown in FIG. 35, the bottle cap drip tray device 600 further comprises a hat crown portion 640 configured to frictionally fit over a top edge portion of the existing bottle cap 172 and/or a top edge portion of the upstanding inner wall portion 612 of the bottle cap drip tray device 600 so that the hat crown portion 640 (i.e., the top cap piece) and the bottle cap drip tray device 600 together form the hat on the head of the animal figurine (i.e., a sombrero-shaped hat disposed on the bear-shaped honey bottle). In FIG. 35, it can be seen that the hat crown portion 640 (i.e., the top cap piece) has an inner sloped wall 642 that extends down to an inner vertical wall 644 that fits over the top edge portion of the existing bottle cap 172 and/or the top edge portion of the upstanding inner wall portion 612.

Figure 36:
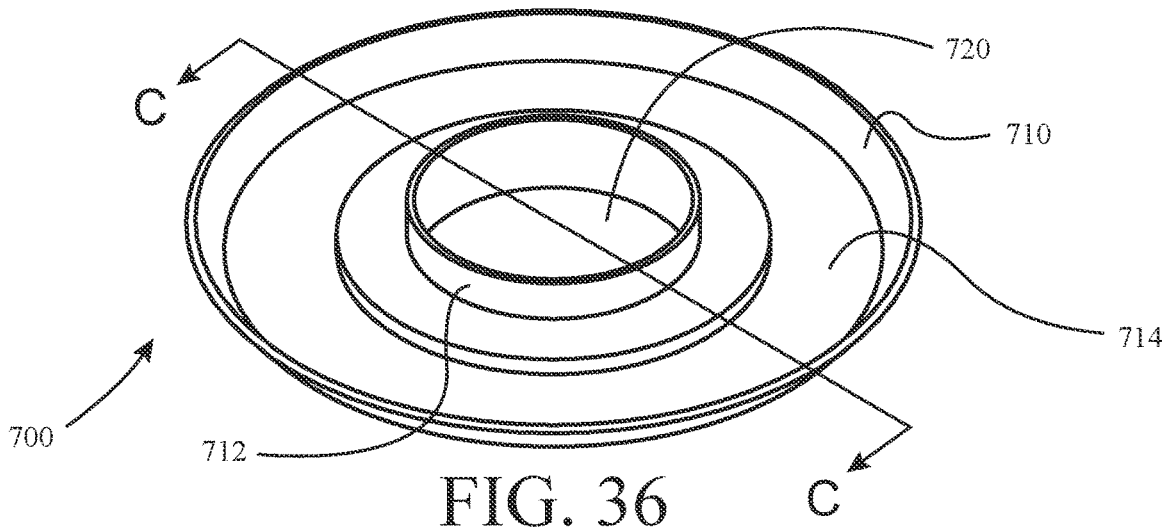
FIG. 36 is a side-top perspective view of a bottle cap drip tray device, according to a seventh illustrative embodiment of the invention.
Figure 37:
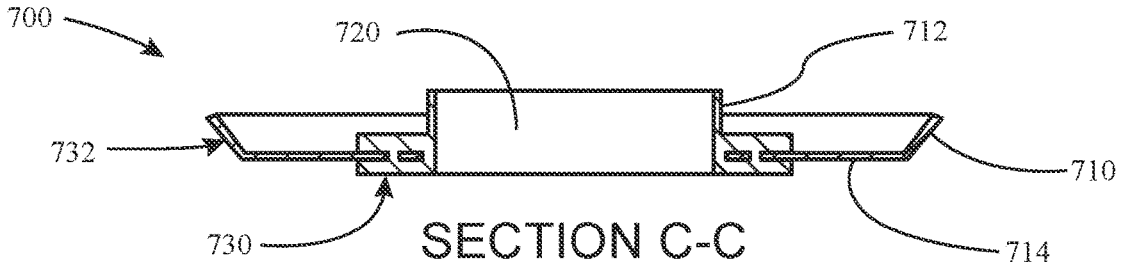
FIG. 37 is a sectional view cut through the bottle cap drip tray device of FIG. 36, wherein the section is generally cut along the cutting-plane line C-C in FIG. 36.
Figure 38:
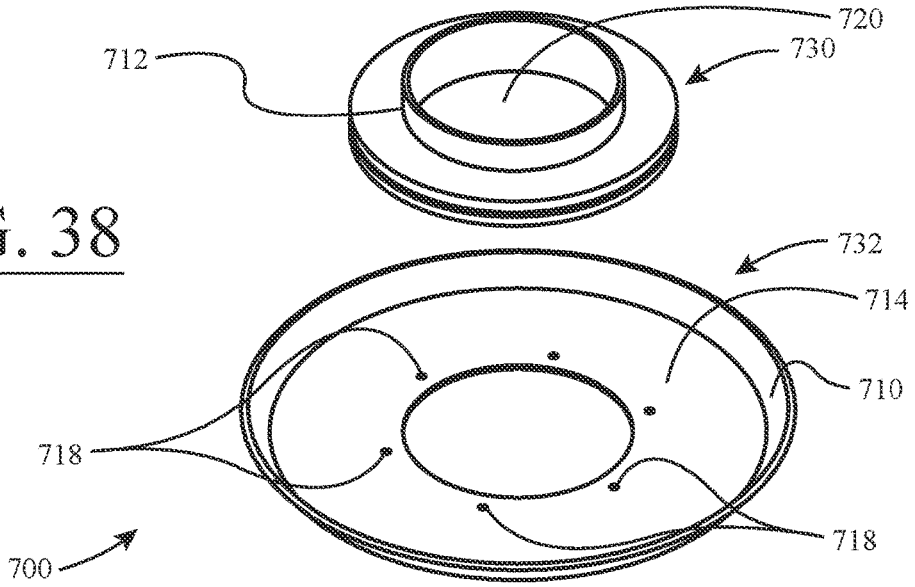
FIG. 38 is an exploded perspective view of the bottle cap drip tray device of FIG. 36.

A seventh illustrative embodiment of a bottle cap drip tray device is seen generally at 700 in FIGS. 36-38. Referring to these figures, it can be seen that, in some respects, the seventh illustrative embodiment is similar to the preceding illustrative embodiments. Moreover, some elements are common to all of the embodiments. For the sake of brevity, the elements that the seventh embodiment of the bottle cap drip tray device has in common with the preceding embodiments will not be discussed because these components have already been described above.

As shown in FIG. 36, similar to the bottle cap drip tray devices 100, 200, 300, 400, 500, 600 described above, the bottle cap drip tray device 700 generally comprises an upstanding inner wall portion 712; an upturned peripheral edge portion 710 extending around an outer periphery of the bottle cap drip tray device 700; and a floor portion 714 extending between the upstanding inner wall portion 712 and the upturned peripheral edge portion 710. The bottle cap drip tray device 700 is configured to prevent a substance being poured from a bottle from dripping down one or more sides of the bottle.

Referring again to FIG. 36, it can be seen that, similar to the sixth illustrative embodiment described above, the bottle cap drip tray device 700 has an annular shape with a central aperture 720 for accommodating an existing bottle cap disposed on a bottle. In the seventh illustrative embodiment, the upstanding inner wall portion 712 of the bottle cap drip tray device 700 defines the central aperture 720, and the upstanding inner wall portion 712 of the bottle cap drip tray device 700 is configured to removably engage a peripheral wall of the existing bottle cap in a friction-fit type engagement.

In the seventh illustrative embodiment, turning to FIGS. 37 and 38, it can be seen that the bottle cap drip tray device 700 has a two-part construction with an inner ring portion 730 formed from a first polymeric material (e.g., silicone) and an outer drip tray portion 732 formed from a second polymeric material (e.g., a plastic that is harder than silicone). In the seventh illustrative embodiment, the first polymeric material (e.g., silicone) is more flexible than the second polymeric material (e.g., a plastic that is harder than silicone) to facilitate engaging the peripheral wall of the existing bottle cap in a friction-type fit. As shown in FIG. 38, the outer drip tray portion 732 may be provided with a plurality of circumferentially spaced apart apertures 718 disposed about an inner periphery of the outer drip tray portion 732 for allowing the first polymeric material to flow through the apertures 718 when the parts 730, 732 are being formed. Once the first polymeric material (e.g., silicone) solidifies, the first polymeric material disposed in the apertures 718 provides a secure bond between the inner ring portion 730 and the outer drip tray portion 732.

As shown in FIGS. 36-38, the upturned peripheral edge portion 710 of the bottle cap drip tray device 700 has an inverted frustoconical shape where the upturned peripheral edge portion 710 of the bottle cap drip tray device 700 is sloped upwardly in an outward direction.

Figure 39:
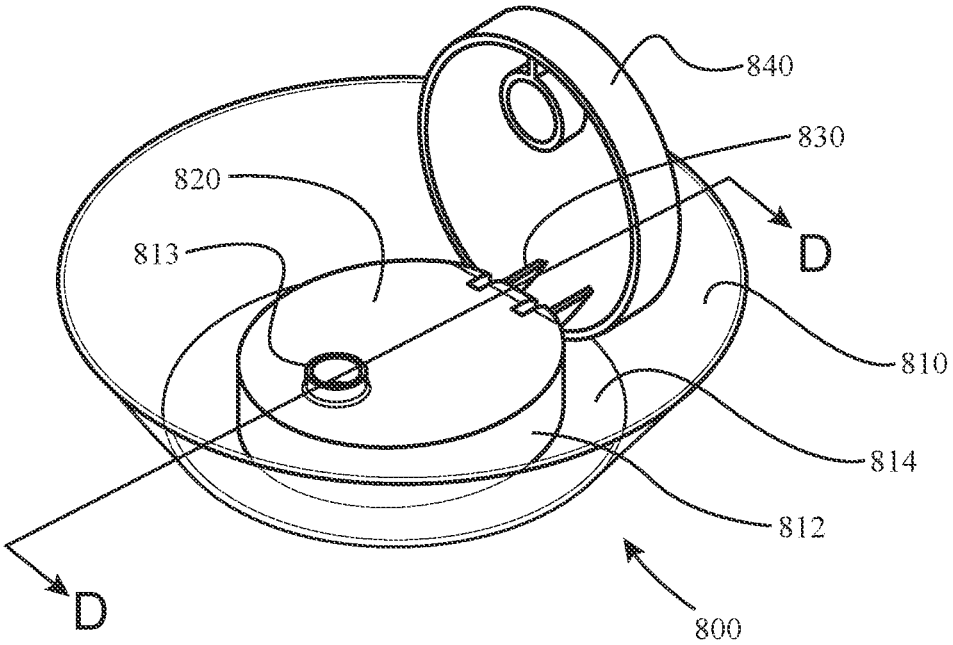
FIG. 39 is a side-top perspective view of a bottle cap drip tray device, according to an eighth illustrative embodiment of the invention, wherein the cap member of the bottle cap drip tray device is in an open position.
Figure 40:
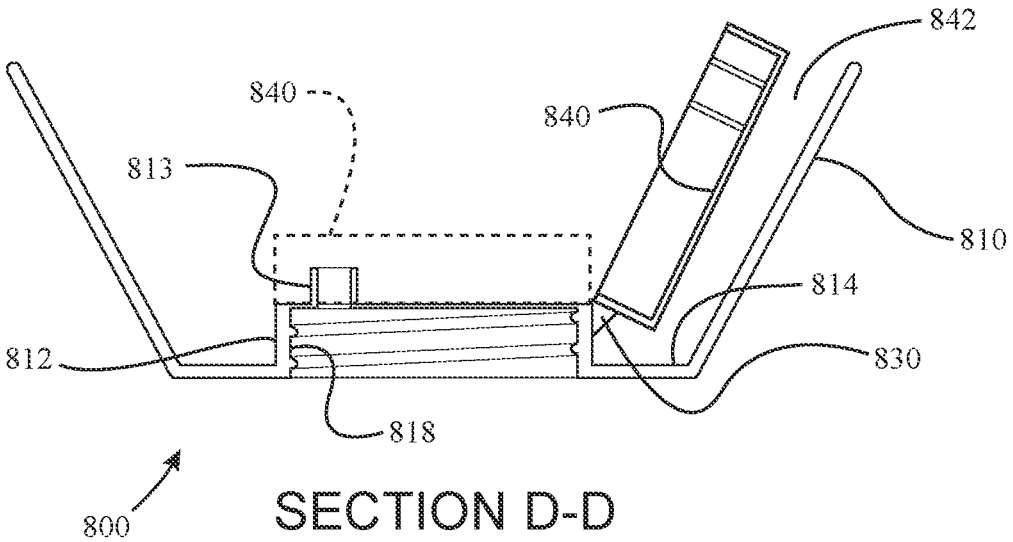
FIG. 40 is a sectional view cut through the bottle cap drip tray device of FIG. 39, wherein the section is generally cut along the cutting-plane line D-D in FIG. 39.

An eighth illustrative embodiment of a bottle cap drip tray device is seen generally at 800 in FIGS. 39 and 40. Referring to these figures, it can be seen that, in some respects, the eighth illustrative embodiment is similar to the preceding illustrative embodiments. Moreover, some elements are common to all of the embodiments. For the sake of brevity, the elements that the eighth embodiment of the bottle cap drip tray device has in common with the preceding embodiments will not be discussed because these components have already been described above.

As shown in FIGS. 39 and 40, similar to the bottle cap drip tray devices 100, 200, 300, 400, 500, 600, 700 described above, the bottle cap drip tray device 800 generally comprises an upstanding inner wall portion 812; an upturned peripheral edge portion 810 extending around an outer periphery of the bottle cap drip tray device 800; and a floor portion 814 extending between the upstanding inner wall portion 812 and the upturned peripheral edge portion 810. The bottle cap drip tray device 800 is configured to prevent a substance being poured from a bottle from dripping down one or more sides of the bottle.

Referring again to FIGS. 39 and 40, similar to the bottle cap drip tray devices 100, 200 described above, the bottle cap drip tray device 800 of the eighth illustrative embodiment further comprises a bottle cap 812, 820, 840 configured to engage with an opening of a bottle. The bottle cap 812, 820, 840 includes a cap base portion 812, 820, the cap base portion 812, 820 formed by the upstanding inner wall portion 812 and a top wall 820 connected to the upstanding inner wall portion 812, and the cap base portion 812, 820 further including a dispensing spout 813 with a dispensing aperture disposed through the top wall 820 for pouring the substance from a bottle. The bottle cap 812, 820, 840 further includes a lid portion 840 pivotably coupled to the cap base portion 812, 820, the lid portion 840 being pivotable between a closed position where the dispensing aperture is covered and an open position (i.e., FIGS. 39 and 40 positions) where the dispensing aperture is accessible for the pouring of the substance.

Also, as shown in FIGS. 39 and 40, the bottle cap 812, 820, 840 of the eighth illustrative embodiment further comprises a hinge member 830 pivotably coupling the lid portion 840 to the cap base portion 812, 820 of the bottle cap 812, 820, 840. In the eighth illustrative embodiment, the hinge member 830 defines a substantially horizontal pivot axis about which the lid portion 840 is rotatable relative to the cap base portion 812, 820 of the bottle cap 812, 820, 840.

Similar to the bottle cap drip tray device 100 described above, with reference to the sectional view of FIG. 40, it can be seen that the circular interior surface of the upstanding inner wall portion 812 of the cap base portion 812, 820 comprises a plurality of internal threads 818 that are configured to threadingly engage with a plurality of corresponding external threads disposed on a neck of a bottle.

Turning again to FIGS. 39 and 40, unlike the bottle cap drip tray device 100 described above, the upturned peripheral edge portion 810 of the bottle cap drip tray device 800 has an inverted frustoconical shape where the upturned peripheral edge portion 810 of the bottle cap drip tray device 800 is sloped upwardly in an outward direction. When the lid portion 840 is pivoted to the open position of FIG. 40, a clearance gap 842 is provided between the lid portion 840 and the interior surface of the upturned peripheral edge portion 810 of the bottle cap drip tray device 800.

It is readily apparent that the aforedescribed bottle cap drip tray device 100, 200, 300, 400, 500, 600, 700, 800 offers numerous advantages. First of all, the bottle cap drip tray device 100, 200, 300, 400, 500, 600, 700, 800 prevents a substance being poured from a bottle from dripping down one or more sides of the bottle (see FIG. 11). In addition, the bottle cap drip tray device 100, 200, 300, 400, 500, 600, 700, 800 prevents bottles becoming dirty and/or sticky as result of the substance being poured therefrom dripping down the one or more sides of the bottle. For example, when the bottle cap drip tray device described herein is used on a honey bottle, the bottle cap drip tray device prevents the bottle from becoming dirty and/or sticky as a result of the honey being poured therefrom dripping down the one or more sides of the bottle. Similarly, when bottle cap drip tray device described herein is applied to other food dispensers, it will prevent these other bottles from becoming dirty with container drips.

Some bottles, such as honey bottles, can become sticky after only one use. When the contents is poured from the bottle, it is difficult if not impossible, to prevent any drips from going down the sides. The bottle is then sticky, resulting in sticky hands after use. Also resulting in the bottle sticking to any surface in which it is placed (i.e., countertops, pantry shelves, etc.). When the bottle cap drip tray device 100, 200, 300, 400, 500, 600, 700, 800 described herein is applied to all different types of bottles, the device 100, 200, 300, 400, 500, 600, 700, 800 will advantageously prevent the dispensed contents of the bottle from dripping down the sides of the bottle, which can cause staining, sticking, or contaminating the surface upon which the bottle sits.

The illustrative embodiments of the bottle cap drip tray device 100, 200, 300, 400, 500, 600, 700, 800 described herein provide one or more of the following benefits: (i) drips running down the sides of bottles are prevented, (ii) prevents hands of a user from becoming sticky or soiled by food, (iii) the device 100, 200, 300, 400, 500, 600, 700, 800 eliminates sticky or dirty bottles, and (iv) the device 100, 200, 300, 400, 500, 600, 700, 800 protects shelving, countertops and other surfaces from drips or food debris.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A bottle cap and drip tray device, comprising:

an upstanding inner wall portion;

an upturned peripheral edge portion forming an outer peripheral boundary of the bottle cap and drip tray device, the upturned peripheral edge portion having a curved upper surface and a curved lower surface, the curved lower surface of the upturned peripheral edge portion being oppositely disposed relative to the curved upper surface, and the curved upper and lower surfaces of the upturned peripheral edge portion being curved in a plane that is parallel to a vertical axis of the bottle cap and drip tray device; and a floor portion extending horizontally between the upstanding inner wall portion and the upturned peripheral edge portion, the floor portion having an upper surface and a lower surface, the lower surface of the floor portion being oppositely disposed relative to the upper surface, the upper surface of the floor portion being adjoined to the curved upper surface of the upturned peripheral edge portion, the lower surface of the floor portion being adjoined to the curved lower surface of the upturned peripheral edge portion, and the curved upper and lower surfaces of the upturned peripheral edge portion each having a varying slope from a first location where the curved upper and lower surfaces adjoin the upper and lower surfaces of the floor portion to a second location at the outer peripheral boundary of the bottle cap and drip tray device;

a bottle cap configured to engage with an opening of a bottle, the bottle cap including:

a cap base portion, the cap base portion formed by the upstanding inner wall portion and a top wall connected to the upstanding inner wall portion, and the cap base portion further including a dispensing aperture disposed through the top wall for pouring a substance from the bottle, the dispensing aperture being located substantially closer to one end of a diameter of the cap base portion than the other end of the diameter;

a lid portion pivotably coupled to the cap base portion, the lid portion being pivotable between a closed position where the dispensing aperture is covered and an open position where the dispensing aperture is accessible for the pouring of the substance; and a hinge member pivotably coupling the lid portion to the cap base portion of the bottle cap, the hinge member defining a pivot axis about which the lid portion is rotatable relative to the cap base portion of the bottle cap, the pivot axis of the hinge member being disposed at an outer edge of, or being disposed below, the top wall of the cap base portion;

wherein the bottle cap and drip tray device is configured to prevent the substance being poured from the bottle from dripping down one or more sides of the bottle.

2. The bottle cap and drip tray device according to claim 1, wherein the pivot axis of the hinge member is in a form of a substantially horizontal pivot axis about which the lid portion is rotatable relative to the cap base portion of the bottle cap.

3. The bottle cap and drip tray device according to claim 2, wherein the hinge member is coupled to the cap base portion by a plurality of downwardly extending resilient prong members that engage with a single slot disposed in the cap base portion, the substantially horizontal pivot axis of the hinge member being disposed above the plurality of downwardly extending resilient prong members.

4. The bottle cap and drip tray device according to claim 2, wherein the hinge member comprises a pair of downwardly extending tabs with respective hinge pins extending from the tabs, and the hinge member is coupled to the cap base portion by the hinge pins engaging with respective pin holes in the cap base portion.

5. The bottle cap and drip tray device according to claim 1, wherein the cap base portion comprises an upstanding collar circumscribing the dispensing aperture, and the lid portion comprises a circular recess at a bottom of the lid portion for accommodating the upstanding collar of the cap base portion when the lid portion is in the closed position.

6. The bottle cap and drip tray device according to claim 1, wherein an interior surface of the upstanding inner wall portion of the cap base portion comprises a plurality of internal threads that are configured to threadingly engage with a plurality of corresponding external threads disposed on a neck of the bottle.

7. The bottle cap and drip tray device according to claim 1, wherein the upturned peripheral edge portion has a top rim and the lid portion of the bottle cap has a top surface, the top rim of the upturned peripheral edge portion being disposed beneath the top surface of the lid portion of the bottle cap.

8. The bottle cap and drip tray device according to claim 1, wherein the bottle has an animal or human figurine shape, and the bottle cap and drip tray device is in a shape of a hat disposed on a head of the animal or human figurine.

9. The bottle cap and drip tray device according to claim 1, wherein the upper surface of the floor portion and/or the curved upper surface of the upturned peripheral edge portion of the bottle cap and drip tray device includes a textured surface portion comprising a plurality of ribs that define recesses between the ribs for trapping the substance being poured from the bottle.

10. A bottle cap and drip tray system, comprising:

a bottle having an animal or human figurine shape, the bottle configured to hold a substance in an interior of the bottle;

a bottle cap and drip tray device configured to be attached to the bottle, the bottle cap and drip tray device being in a shape of a hat disposed on a head of the animal or human figurine, and the bottle cap and drip tray device including:

an upstanding inner wall portion;

an upturned peripheral edge portion forming an outer peripheral boundary of the bottle cap and drip tray device; and a floor portion extending horizontally between the upstanding inner wall portion and the upturned peripheral edge portion, the upturned peripheral edge portion surrounding the floor portion;

a bottle cap configured to engage with an opening of the bottle, the bottle cap including:

a cap base portion, the cap base portion formed by the upstanding inner wall portion and a top wall connected to the upstanding inner wall portion, the top wall of the cap base portion being generally planar, and the cap base portion further including a dispensing aperture disposed through the top wall for pouring a substance from the bottle;

a lid portion pivotably coupled to the cap base portion, the lid portion being pivotable between a closed position where the dispensing aperture is covered and an open position where the dispensing aperture is accessible for the pouring of the substance; and a hinge member pivotably coupling the lid portion to the cap base portion of the bottle cap, the hinge member defining a pivot axis about which the lid portion is rotatable relative to the cap base portion of the bottle cap, the pivot axis of the hinge member being disposed at an outer edge of, or being disposed below, the top wall of the cap base portion;

wherein the bottle cap and drip tray device is configured to prevent the substance from dripping down one or more sides of the bottle when the substance is being poured from the bottle.

11. The bottle cap and drip tray system according to claim 10, wherein the substance that is configured to be poured from the bottle comprises a viscous liquid, and the bottle cap and drip tray device is configured to prevent the viscous liquid from dripping down one or more sides of the bottle when the viscous liquid is being poured from the bottle.

12. A bottle cap and drip tray device, comprising:

an upstanding inner wall portion;

an upturned peripheral edge portion forming an outer peripheral boundary of the bottle cap and drip tray device; and a floor portion extending between the upstanding inner wall portion and the upturned peripheral edge portion;

a bottle cap configured to engage with an opening of a bottle, the bottle cap including:

a cap base portion, the cap base portion formed by the upstanding inner wall portion and a top wall connected to the upstanding inner wall portion, and the cap base portion further including a dispensing aperture disposed through the top wall for pouring a substance from the bottle, the dispensing aperture being located substantially closer to one end of a diameter of the cap base portion than the other end of the diameter;

a lid portion pivotably coupled to the cap base portion, the lid portion being pivotable between a closed position where the dispensing aperture is covered and an open position where the dispensing aperture is accessible for the pouring of the substance; and a hinge member pivotably coupling the lid portion to the cap base portion of the bottle cap, the hinge member defining a pivot axis about which the lid portion is rotatable relative to the cap base portion of the bottle cap, the hinge member being coupled to the cap base portion by one or more downwardly extending resilient prong members that engage with a slot disposed in the cap base portion, the one or more downwardly extending resilient prong members extending below the top wall of the cap base portion, the pivot axis of the hinge member being disposed above the one or more downwardly extending resilient prong members, and the pivot axis of the hinge member being disposed at an outer edge of the top wall of the cap base portion;

wherein the bottle cap and drip tray device is configured to prevent the substance from dripping down one or more sides of the bottle when the substance is being poured from the bottle.

13. The bottle cap and drip tray device according to claim 12, wherein the hinge member further comprises a hinge base portion, the one or more downwardly extending resilient prong members extending downwardly from a bottom surface of the hinge base portion, and the hinge base portion of the hinge member being configured to be received within a notch of the cap base portion.

* * * * *